US005891615A

United States Patent [19]

Winslow et al.

[11] Patent Number: 5,891,615

[45] Date of Patent: Apr. 6, 1999

[54] CHEMICAL SENSITIZATION OF PHOTOTHERMOGRAPHIC SILVER HALIDE EMULSIONS

[75] Inventors: John M. Winslow, South St. Paul; Gary L. Featherstone, Oakdale; Doreen C. Lynch, Afton, all of Minn.; James R. Miller, Hudson, Wis.; Sharon M. Simpson, Lake Elmo; Mark C. Skinner, Afton, both of Minn.

[73] Assignee: Imation Corp., Oakdale, Minn.

[21] Appl. No.: 841,953

[22] Filed: Apr. 8, 1997

[51] Int. Cl.[6] ..... G03C 1/09; G03C 1/00

[52] U.S. Cl. ..... 430/603; 430/569; 430/570; 430/600; 430/604; 430/611; 430/613

[58] Field of Search ..... 430/569, 570, 430/619, 603, 604, 600, 611, 613, 581, 577, 944

[56] References Cited

U.S. PATENT DOCUMENTS

| | | |
|---|---|---|
| 1,623,499 | 4/1927 | Sheppard et al. . |
| 2,131,038 | 9/1938 | Brooker et al. . |
| 2,399,083 | 4/1946 | Waller et al. . |
| 2,444,605 | 12/1948 | Heimbach et al. . |
| 2,489,341 | 11/1949 | Waller et al. . |
| 2,565,418 | 8/1951 | Yackel . |
| 2,566,263 | 8/1951 | Trivelli et al. . |
| 2,588,765 | 3/1952 | Robijns et al. . |
| 2,597,915 | 5/1952 | Yutzy et al. . |
| 2,614,928 | 10/1952 | Yutzy et al. . |
| 2,618,556 | 11/1952 | Hewitson et al. . |
| 2,681,294 | 6/1954 | Beguin . |
| 2,694,716 | 11/1954 | Allen et al. . |
| 2,701,245 | 2/1955 | Lynn . |
| 2,728,663 | 12/1955 | Allen et al. . |
| 2,761,791 | 9/1956 | Russell . |
| 2,839,405 | 6/1958 | Jones . |
| 2,861,056 | 11/1958 | Minsk . |
| 2,886,437 | 5/1959 | Piper . |
| 2,960,404 | 11/1960 | Milton et al. . |
| 2,992,101 | 7/1961 | Jelley et al. . |
| 3,080,254 | 3/1963 | Grant, Jr. . |
| 3,121,060 | 2/1964 | Duane . |
| 3,201,678 | 8/1965 | Meixell . |
| 3,206,312 | 9/1965 | Sterman et al. . |
| 3,220,839 | 11/1965 | Herz et al. . |
| 3,235,652 | 2/1966 | Lindsey . |
| 3,241,969 | 3/1966 | Hart et al. . |
| 3,287,135 | 11/1966 | Anderson et al. . |
| 3,297,446 | 1/1967 | Dunn . |
| 3,297,447 | 1/1967 | McVeigh . |
| 3,330,663 | 7/1967 | Weyde et al. . |
| 3,428,451 | 2/1969 | Trevoy . |
| 3,457,075 | 7/1969 | Morgan et al. . |
| 3,700,458 | 10/1972 | Lindholm . |
| 3,719,495 | 3/1973 | Lea . |

(List continued on next page.)

FOREIGN PATENT DOCUMENTS

| | | |
|---|---|---|
| 0600589 | 6/1994 | European Pat. Off. . |
| 0 627 660 | 12/1994 | European Pat. Off. . |
| 0 713 132 | 5/1996 | European Pat. Off. . |
| 49-13224 | 2/1974 | Japan . |
| 51-42529 | 4/1976 | Japan . |
| 52-126780 | 10/1977 | Japan . |
| 623448 | 5/1949 | United Kingdom . |
| 837095 | 6/1960 | United Kingdom . |
| 955061 | 4/1964 | United Kingdom . |
| 1 325 312 | 8/1973 | United Kingdom . |
| 1 447 454 | 8/1976 | United Kingdom . |
| WO 95/23357 | 8/1995 | WIPO . |

OTHER PUBLICATIONS

*Unconventional Imaging Processes*, E. Brinekman et al., Ed.; The Focal Press, London and New York, 74–75 (1978).

T. H. James, "The Mechanism of Development," Chapter 13 of *The Theory of the Photographic Process, Fourth Ed.,* Eastman Kodak Company, Rochester, New York, 373–374 (1977).

"Photothermographic Silver Halide Material and Process," Item 22812 in *Research Disclosure,* pp. 155–156 (Apr. 1983).

"Carbamoyloxy Substituted Couplers in a Photothermographic Element and Process," Item 23419 in *Research Disclosure,* pp. 314–315 (Oct. 1983).

M. Schmidt et al., "Thio–unterbromige Säure," *Angew. Chem.,* 72: 79 (1960).

S. E. Sheppard et al., "Studies in Photographic Sensitivity, III. Topochemistry of Development and Sensitizing Nuclei," *J. Franklin Inst.,* 196: 653–673 (1923).

S. E. Sheppard et al., "Studies in Photographic Sensitivity, III. Topochemistry of Development and Sensitizing Nuclei," *J. Franklin,* Inst., 196: 779–803 (1923).

D. H. Klosterboer, "Thermally Processed Silver Systems, "Chapter 9 of *Imaging Processes and Materials, Neblette's Eighth Edition,* J. Sturge et al., Ed., Van Nostrand Reinhold, New York, 279–291 (1989).

S. Tsukamoto, "Synthesis and Structure– Activity Studies of a Series of Spirooxazolidine2,4–diones: 4–Oxa Analogues of the Muscarinic Agonist 2–Ethyl–8–methyl–2,8–diazaspiro[4.5]decane–1,3–dione," *J. Med. Chem.,* 36: 2292–2299 (1993).

C. Zou et al., "Mechanisms of Latent Image Formation in Photothermographic Silver Imaging Media," *J. Imaging Sci. Technol.,* 40: 94–103 (1996).

Mees and James, *The Theory of the Photographic Process,* 4th edition, 1977, p. 152.

V. A. Rimas, A. A. Sauka *Uch. Zap. Rizhsk. Politekh. Inst.* 1965, 16, 229–203 (C.A. 1967, 67, 70148m).

*Research Disclosure,* Jun. 1978, Item No. 17029.

*Primary Examiner*—Thorl Chea
*Attorney, Agent, or Firm*—William K. Weimer

[57] ABSTRACT

Chemical sensitization of silver halide photothermographic emulsions used in photothermographic elements, can be effected by the decomposition of sulfur containing compounds on or around the surface of the silver halide grains, usually under oxidizing conditions at elevated temperatures. Alignment of the sulfur containing compounds on the surface of the grains, can be accomplished with spectral sensitizing dyes and appears to be particularly effective in providing strong chemical sensitization effects.

19 Claims, No Drawings

U.S. PATENT DOCUMENTS 3,761,279 9/1973 Mauriac et al. .
3,785,830 1/1974 Sullivan et al. .
3,839,049 10/1974 Simons .
3,846,136 11/1974 Sullivan .
3,847,612 11/1974 Winslow .
3,985,565 10/1976 Gabrielsen et al. .
3,994,732 11/1976 Winslow .
4,001,025 1/1977 Cash .
4,021,249 5/1977 Noguchi et al. .
4,076,539 2/1978 Ikenoue et al. .
4,123,274 10/1978 Knight et al. .
4,123,282 10/1978 Winslow .
4,207,108 6/1980 Hiller .
4,213,784 7/1980 Ikenoue et al. .
4,220,709 9/1980 deMauriac .
4,260,677 4/1981 Winslow et al. .
4,374,921 2/1983 Frenchik .
4,708,928 11/1987 Geisler .
4,725,534 2/1988 Kagami et al. .
4,761,361 8/1988 Ozaki et al. .
4,775,613 10/1988 Hirai et al. .
5,028,523 7/1991 Skoug .
5,135,842 8/1992 Kitchin et al. .
5,158,866 10/1992 Simpson et al. .
5,175,081 12/1992 Krepski et al. .
5,185,231 2/1993 Weigel .
5,226,452 7/1993 Muller et al. .
5,262,295 11/1993 Tanaka et al. .
5,279,928 1/1994 Dedio et al. .
5,281,515 1/1994 Delprato et al. ..... 430/577
5,298,390 3/1994 Sakizadeh et al. .
5,300,420 4/1994 Kenney et al. .
5,310,640 5/1994 Markin et al. .
5,314,795 5/1994 Helland et al. .
5,340,613 8/1994 Hanzalik et al. .
5,380,635 1/1995 Gomez et al. .
5,380,644 1/1995 Yonkoski et al. .
5,382,504 1/1995 Shor et al. .
5,434,043 7/1995 Zou et al. .
5,441,866 8/1995 Miller et al. .
5,460,938 10/1995 Kirk et al. .
5,491,059 2/1996 Whitcomb .
5,496,695 3/1996 Simpson et al. .
5,541,054 7/1996 Miller et al. .
5,541,055 7/1996 Ooi et al. .
5,545,505 8/1996 Simpson .
5,545,507 8/1996 Simpson et al. .
5,545,515 8/1996 Murray et al. .
5,558,983 9/1996 Simpson et al. .
5,635,339 6/1997 Murray .
5,637,449 6/1997 Harring et al. .
5,654,130 8/1997 Murray .
5,686,228 11/1997 Murray et al. .
5,705,324 1/1998 Murray .

CHEMICAL SENSITIZATION OF PHOTOTHERMOGRAPHIC SILVER HALIDE EMULSIONS

BACKGROUND OF THE INVENTION

1. Field of Invention

This invention relates to the chemical sensitization of silver halide photothermographic emulsions.

2. Background of the Art

Silver halide-containing photothermographic imaging materials (i.e., heat-developable photographic elements) processed with heat, and without liquid development, have been known in the art for many years. These materials are also known as "dry silver" compositions or emulsions and generally comprise a support having coated thereon: (a) a photosensitive compound that generates silver atoms when irradiated; (b) a relatively or completely non-photosensitive, reducible silver source; (c) a reducing agent (i.e., a developer) for silver ion, for example the silver ion in the non-photosensitive, reducible silver source; and (d) a binder.

Photographic silver halide has its own natural response to radiation, both in wavelength (i.e., spectral sensitivity) and efficiency (i.e., speed). Each of the various pure halides (silver bromide, silver chloride and silver iodide) have their own distinctive wavelengths of sensitivity within the UV, near UV and blue regions of the electromagnetic spectrum. The primary halides used in the formation of photographic silver halides are the chlorides and bromides, with the iodides present as minor proportions, almost always less than 25 molar percent of the total crystal composition. Mixtures of the various silver halides within single grains (e.g., silver chlorobromide, silver chloroiodide, silver bromochloroiodide, silver iodobromide, etc.) would have sensitivities to various different regions of the electromagnetic spectrum, but still within the UV to blue region of the spectrum. The silver halide grains, when constructed and composed of only silver and halogen atoms would also have defined levels of sensitivity based upon their halide content, crystalline morphology (the shape and structure of the crystals or grains), and other artifacts which may or may not have been readily controlled by the silver halide chemist over the years. Such features as crystal defects, crystal stresses, dopants, halide composition, and other structural features have been noted as influential on the sensitometric response of grains and have been purposefully introduced over the years to affect the sensitometry of the emulsions.

The efforts to influence the speed of silver halide grains in general may be broken down into the following categories:

1) Crystal composition,
2) Crystal shape or morphology,
3) Crystal structure,
4) Chemical sensitization (and particularly sulfur sensitization),
5) Reduction sensitization,
6) Dopants,
7) Spectral sensitization, and
8) Supersensitization.

The first three mechanisms have been briefly described above.

Chemical sensitization is a process during the crystal making process in which sensitizing specks of materials such as silver salts (e.g., $Ag_2S$) or even silver metal are introduced onto (usually) or into the individual grains. The introduction of silver sulfide specs, for example, is usually done by direct reaction of active sulfur contributing compounds with the silver halide during various stages in the silver halide growth process. The presence of the specks increases the speed or sensitivity of the grains to light and/or development. The first observation of sulfur sensitization came from early findings that different gelatin binders would often produce different degrees of sensitivity in silver halide emulsions, so the source of the speed increasing component was investigated and found to be sulfur contributing compounds. Thiosulfate compounds are still typically used as a labile sulfur compound. Other materials such as allylthiourea are also used. Certain studies (e.g., by Sheppard, Trevelli and Wightman *J. Franklin Inst.,* 1923, 196, 653, 673) using micrography, found that the treatment of silver halide grains with allylthiourea solution followed by carbonate solution resulted in the formation of black specks rather than a distribution of silver halide over the grain surface (Mees and James, *The Theory of the Photographic Process,* 4th edition, 1977, p. 152.). It has also been suggested that the thiourea rearranges itself on the surface of the grains to active configurations in the generation of silver sulfide specks (Mees and James, supra, p. 153). It has also been suggested that the thiosulfate acts to sensitize the silver halide by $AgSO_3^-$ adsorbed to the crystal surface.

Reduction sensitization is somewhat similar to chemical sensitization, but distinguishable therefrom, and is a process by which other chemical species, besides silver sulfide, are deposited or reacted into or onto the silver halide grains during a segment of the silver halide grain growth and finishing steps. The term reduction sensitization, although generically considered within the term of chemical sensitization, refers specifically to describe emulsions sensitized by the action of reducing agents on the silver halide grains. Materials which have been used as reduction sensitizers include stannous chloride, hydrazine, ethanolamine, and thioureaoxide.

Dopants most importantly include gold sensitization where the silver halide grains are treated with gold containing ions such as tetrachloroaurate (III) or dithiocyanurate(I). Thiocyanate has been suggested as being capable of increasing gold sensitization (Mees and James, supra, p.155). The gold is most preferably added at the later stages of silver halide grain formation, such as during ripening, after grain growth. Other metals such as platinum and palladium are also known in the art to have some effects similar, but not as specifically beneficial as gold. Still other metal dopants such as iridium, rhodium, ruthenium and the like are known more for contrast or high intensity reciprocity effects than for speed sensitization effects.

Spectral sensitization is the addition of compounds to silver halide grains which absorb radiation at wavelengths other than those to which silver halide is naturally sensitive (i.e., only within the UV to blue) or which absorb radiation more efficiently than silver halide (even within those natural regions of spectral sensitivity). It is generally recognized that spectral sensitizers extend the responses of photosensitive silver halide to longer wavelengths and can accomplish spectral sensitization in the UV, visible or infrared regions of the electromagnetic spectrum. These compounds, after absorption of the radiation, transfer energy to the silver halide grains to cause the necessary local photoinduced reduction of silver salt to silver metal. The compounds are usually dyes, and the best method of spectrally sensitizing silver halide grains causes or allows the dyes to align themselves on the surface of the silver halide grain, particularly in a stacked, almost crystalline pattern on the surface of the individual grains.

Supersensitization is a process whereby the speed of a spectrally sensitized photographic silver halide is increased by the addition of another compound, which may or may not be a dye. This is not merely an additive effect of two compounds, as it is understood in the art. For example, where two separate dyes are used, one as the spectral sensitizer and the other as a supersensitizer, the surface of the grain still may not have more than a defined amount of dye present, yet the combination of the two dyes will provide a speed which is superior to that of either dye alone, even when optimized.

These various speed enhancing processes may of course be combined in the formulation of a specific photographic emulsion, as the situation requires.

In photothermographic emulsions, the photosensitive compound is generally photographic silver halide which must be in catalytic proximity to the non-photosensitive, reducible silver source. Catalytic proximity requires an intimate physical association of these two materials so that when silver atoms (also known as silver specks, clusters, or nuclei) are generated by irradiation or light exposure of the photographic silver halide, those nuclei are able to catalyze the reduction of the reducible silver source within a catalytic sphere of influence around the silver specs. It has long been understood that silver atoms (Ag°) are a catalyst for the reduction of silver ions, and that the photosensitive silver halide can be placed into catalytic proximity with the non-photosensitive, reducible silver source in a number of different fashions. The silver halide may be made "in situ," for example by adding a halogen-containing source to the reducible silver source to achieve partial metathesis (see, for example, U.S. Pat. No. 3,457,075); or by coprecipitation of silver halide and the reducible silver source (see, for example, U.S. Pat. No. 3,839,049). The silver halide may also be pre-formed (i.e., made "ex situ") and added to the organic silver salt. The addition of silver halide grains to photothermographic materials is described in *Research Disclosure*, June 1978, Item No. 17029. The reducible silver source may also be generated in the presence of these ex situ, pre-formed silver halide grains. It is reported in the art that when silver halide is made ex situ, one has the possibility of controlling the composition and size of the grains much more precisely, so that one can impart more specific properties to the photothermographic element and can do so much more consistently than with the in situ technique.

The non-photosensitive, reducible silver source is a compound that contains silver ions. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. Salts of other organic acids or other organic compounds, such as silver imidazolates, have been proposed. U.S. Pat. No. 4,260,677 discloses the use of complexes of inorganic or organic silver salts as non-photosensitive, reducible silver sources.

In both photographic and photothermographic emulsions, exposure of the photographic silver halide to light produces small clusters of silver atoms (Ag°). The imagewise distribution of these clusters is known in the art as a latent image. This latent image is generally not visible by ordinary means. Thus, the photosensitive emulsion must be further processed to produce a visible image. This is accomplished by the reduction of silver ions which are in catalytic proximity to silver halide grains bearing the clusters of silver atoms, (i.e., the latent image). This produces a black and white image. In photographic elements, the silver halide is reduced to form the black-and-white negative image in a conventional black-and-white negative imaging process. In photothermographic elements, the light-insensitive silver source is reduced to form the visible black-and-white negative image while much of the silver halide remains as silver halide and is not reduced.

The reducing agent for silver ion of the light-insensitive silver salt, often referred to as a "developer," may be any compound, preferably any organic compound, that can reduce silver ion to metallic silver, and is preferably of relatively low activity until it is heated to a temperature above 100° C. At elevated temperatures, in the presence of the latent image, the non-photosensitive reducible silver source (e.g., silver behenate) is reduced by the reducing agent for silver ion. This produces a negative black-and-white image of elemental silver.

While conventional photographic developers such as methyl gallate, hydroquinone, substituted-hydroquinones, catechol, pyrogallol, ascorbic acid, and ascorbic acid derivatives are useful, they tend to result in very reactive photothermographic formulations and fog during preparation and coating of photothermographic elements. As a result, hindered phenol developers (i.e., reducing agents) have traditionally been preferred.

As the visible image in black-and-white photothermographic elements is usually produced entirely by elemental silver (Ag°), one cannot readily decrease the amount of silver in the emulsion without reducing the maximum image density. However, reduction of the amount of silver is often desirable to reduce the cost of raw materials used in the emulsion and/or to enhance performance. For example, toning agents may be incorporated to improve the color of the silver image of the photothermographic elements as described in U.S. Pat. Nos. 3,846,136; 3,994,732; and 4,021,249.

Another method of increasing the maximum image density in photographic and photothermographic emulsions without increasing the amount of silver in the emulsion layer is by incorporating dye-forming or dye-releasing compounds in the emulsion. Upon imaging, the dye-forming or dye-releasing compound is oxidized, and a dye and a reduced silver image are simultaneously formed in the exposed region. In this way, a dye-enhanced black-and-white silver image can be produced. Dye enhanced black-and-white silver image forming elements and processes are described in, for example, U.S. Pat. No. 5,185,231.

Many cyanine and related dyes are well known for their ability to impart spectral sensitivity to a gelatino silver halide element. The wavelength of peak sensitivity is a function of the dye's wavelength of peak light absorbance. While many such dyes provide some spectral sensitization in photothermographic formulations, the dye sensitization is often very inefficient and it is not possible to translate the performance of a dye in gelatino silver halide elements to photothermographic elements. The emulsion making procedures and chemical environment of photothermographic elements are very harsh compared to those of gelatino silver halide elements. The presence of large surface areas of fatty acids and fatty acid salts restricts the surface deposition of sensitizing dyes onto silver halide surfaces and may remove sensitizing dye from the surface of the silver halide grains. The large variations in pressure, temperature, pH and solvency encountered in the preparation of photothermographic formulation aggravate the problem. Thus sensitizing dyes which perform well in gelatino silver halide elements are often inefficient in photothermographic formulations. In general, it has been found that merocyanine dyes are superior to cyanine dyes in photothermographic formulations as disclosed, for example, in British Patent No 1,325,312 and U.S. Pat. No. 3,719,495. Recently, certain cyanine dyes have been disclosed as spectral sensitizers for use in photothermographic elements. For example, U.S. Pat. Nos. 5,441,866 and 5,541,054 describe photothermographic elements spectrally sensitized with benzothiazole heptamethine dyes substituted with various groups, including alkoxy and thioalkyl.

Although spectral sensitizing dyes for photothermographic elements are now known which absorb throughout the visible and near-infrared regions (i.e., 400–850 nm) photothermographic emulsions which provide higher photospeeds and which have improved shelf-life stability, sensitivity, contrast and low Dmin are still needed for photothermography.

U.S. Pat. No. 4,207,108 (Hiller) describes improved speed in photothermographic materials by addition of a photographic speed increasing concentration of a certain non-dye, thione speed increasing addendum (including compounds with cyclic thiocarbonyl [>C═S] groups within the cyclic structure). No decomposition of the cyclic thione compounds is reported.

U.S. Pat. No. 5,541,055 (Ooi et al.) describes photothermographic elements which comprise both a cyanine dye and a colorless cyclic carbonyl compound. Rhodanine, hydantoin, barbituric acid, or derivatives thereof (all shown to be monocyclic in columns 4–6) are particularly preferred as the colorless cyclic carbonyl compound.

The recent commercial availability of relatively high powered semiconductor light sources, and particularly laser diodes which emit in the red and near-infrared region of the electromagnetic spectrum, as sources for output of electronically stored image data onto photosensitive film or paper is becoming increasingly widespread. This has led to a need for high quality imaging articles which are sensitive at these wavelengths and has created a need for more highly sensitive photothermographic elements to match such exposure sources both in wavelength and intensity. Such articles find particular utility in laser scanners.

Differences Between Photothermography and Photography

The imaging arts have long recognized that the field of photothermography is clearly distinct from that of photography. Photothermographic elements differ significantly from conventional silver halide photographic elements which require wet-processing.

In photothermographic imaging elements, a visible image is created by heat as a result of the reaction of a developer incorporated within the element. Heat is essential for development and temperatures of over 100° C. are routinely required. In contrast, conventional wet-processed photographic imaging elements require processing in aqueous processing baths to provide a visible image (e.g., developing and fixing baths) and development is usually performed at a more moderate temperature (e.g., 30–50° C.).

In photothermographic elements only a small amount of silver halide is used to capture light and a different form of silver (e.g., silver behenate) is used to generate the image with heat. Thus, the silver halide serves as a catalyst for the physical development of the non-photosensitive, reducible silver source. In contrast, conventional wet-processed black-and-white photographic elements use only one form of silver (e.g., silver halide); which, upon chemical development, is itself converted to the silver image; or which upon physical development requires addition of an external silver source. Additionally, photothermographic elements require an amount of silver halide per unit area that is as little as one-hundredth of that used in conventional wet-processed silver halide.

Photothermographic systems employ a light-insensitive silver salt, such as silver behenate, which participates with the developer in developing the latent image. In contrast, chemically developed photographic systems do not employ a light-insensitive silver salt directly in the image-forming process. As a result, the image in photothermographic elements is produced primarily by reduction of the light-insensitive silver source (silver behenate) while the image in photographic black-and-white elements is produced primarily by the silver halide.

In photothermographic elements, all of the "chemistry" of the system is incorporated within the element itself. For example, photothermographic elements incorporate a developer (i.e., a reducing agent for the non-photosensitive reducible source of silver) within the element while conventional photographic elements do not. The incorporation of the developer into photothermographic elements can lead to increased formation of "fog" upon coating of photothermographic emulsions. Even in so-called instant photography, the developer chemistry is physically separated from the photosensitive silver halide until development is desired. Much effort has gone into the preparation and manufacture of photothermographic elements to minimize formation of fog upon coating, storage, and post-processing aging.

Similarly, in photothermographic elements, the unexposed silver halide inherently remains after development and the element must be stabilized against further development. In contrast, the silver halide is removed from photographic elements after development to prevent further imaging (i.e., the fixing step).

In photothermographic elements the binder is capable of wide variation and a number of binders are useful in preparing these elements. In contrast, photographic elements are limited almost exclusively to hydrophilic colloidal binders such as gelatin.

Because photothermographic elements require thermal processing, they pose different considerations and present distinctly different problems in manufacture and use. In addition, the effects of additives (e.g., stabilizers, antifoggants, speed enhancers, sensitizers, supersensitizers, etc.) which are intended to have a direct effect upon the imaging process can vary depending upon whether they have been incorporated in a photothermographic element or incorporated in a photographic element.

Because of these and other differences, additives which have one effect in conventional silver halide photography may behave quite differently in photothermographic elements where the underlying chemistry is so much more complex. For example, it is not uncommon for an antifoggant for a silver halide system to produce various types of fog when incorporated into photothermographic elements.

Distinctions between photothermographic and photographic elements are described in *Imaging Processes and Materials* (*Neblette's Eighth Edition*); J. Sturge et al. Ed; Van Nostrand Reinhold: New York, 1989, Chapter 9; in *Unconventional Imaging Processes*; E. Brinckman et al, Ed; The Focal Press: London and New York: 1978, pp. 74–75; and in C. Zou, M. R. V. Shayun, B. Levy, and N. Serpone *J. Imaging Sci. Technol.* 1996, 40, 94–103.

SUMMARY OF THE INVENTION

The present invention provides a method for chemically sensitizing silver halide grains in a photothermographic emulsion. The method comprises the steps of:

(a) providing a photothermographic emulsion comprising silver halide grains and a non-photosensitive silver source;

(b) providing a sulfur-containing compound positioned on or around the silver halide grains;

(c) sensitizing the silver halide grains by decomposing the sulfur-containing compound on or around the silver halide grains.

The present invention also provides chemically sensitized silver halide photothermographic emulsions prepared by the method described above.

The present invention provides a method of making a photothermographic element comprising:

(a) preparing a chemically sensitized photothermographic emulsion as described above;

(b) adding a reducing agent and a binder to the photothermographic emulsion;

(c) coating the photothermographic emulsion on a substrate.

The present invention also provides a photothermographic element (black-and-white or color) prepared by the method described above.

The present invention additionally provides a method for chemically sensitizing silver halide grains comprising the steps of:

(a) providing silver halide grains;

(b) providing a sulfur-containing compound on or around the surface of silver halide grains;

(c) decomposing the sulfur-containing compound thereby chemically sensitizing said grains.

The chemically sensitized photothermographic elements of this invention can be used, for example, in conventional black-and-white, monochrome, or full color photothermography; in electronically generated black-and-white or color hardcopy recording; in the graphic arts area (e.g., phototypesetting); in digital proofing; and in digital radiographic imaging. The chemically sensitized photothermographic elements of this invention provide high photospeed; with stable, strongly absorbing, high density, black-and-white or color images of high resolution and good sharpness; and provide a dry and rapid process.

When the photothermographic elements of this invention are imagewise exposed and then heat developed, preferably at a temperature of from about 80° C. to about 250° C. (176° F. to 482° F.) for a duration of from about 1 second to about 2 minutes, in a substantially water-free condition, a (black-and-white or color-containing) silver image is obtained.

Heating in a substantially water-free condition as used herein, means heating at a temperature of 80° to 250° C. with little more than ambient water vapor present. The term "substantially water-free condition" means that the reaction system is approximately in equilibrium with water in the air, and water for inducing or promoting the reaction is not particularly or positively supplied from the exterior to the element. Such a condition is described in T. H. James, *The Theory of the Photographic Process*, Fourth Edition, Macmillan 1977, page 374.

As used herein:

"Photothermographic element" means a construction comprising at least one photothermographic emulsion layer or a two trip photothermographic set of layers (the "two-trip coating where the silver halide and the reducible silver source are in one layer and the other essential components or desirable additives are distributed as desired in an adjacent coating layer) and any supports, topcoat layers, image-receiving layers, blocking layers, antihalation layers, subbing or priming layers, etc.

"emulsion layer" means a layer of a photothermographic element that contains the non-photosensitive, reducible silver source and the photosensitive silver halide;

"ultraviolet region of the spectrum" means that region of the spectrum less than or equal to about 400 nm, preferably from about 100 nm to about 400 nm (sometimes marginally inclusive up to 405 or 410 nm, although these ranges are often visible to the naked human eye), preferably from about 100 nm to about 400 nm. More preferably, the ultraviolet region of the spectrum is the region between about 190 nm and about 400 nm;

"short wavelength visible region of the spectrum" means that region of the spectrum from about 400 nm to about 450 nm;

"infrared region of the spectrum" means from about 750 nm to about 1400 nm; preferably from about 750 nm to about 1000 nm.

"visible region of the spectrum" means from about 400 nm to about 750 nm; and

"red region of the spectrum" means from about 600 nm to about 750 nm. Preferably the red region of the spectrum is from about 630 nm to about 700 nm.

As is well understood in this area, substitution is not only tolerated, but is often advisable and substitution is anticipated on the sulfur containing chemical sensitizing compounds used in the present invention.

In the compounds disclosed herein, when a general structure is referred to as "a compound having the central nucleus" of a given formula, any substitution which does not alter the bond structure of the formula or the shown atoms within that structure is included within the formula, unless such substitution is specifically excluded by language (such as "free of carboxy-substituted alkyl"). For example, where there is a rigidized polymethine chain shown between two defined benzothiazole groups, substituent groups may be placed on the chain, on the rings in the chain, or on the benzothiazole groups, but the conjugation of the chain may not be altered and the atoms shown in the chain or in the benzothiazole groups may not be replaced.

When a general structure is referred to as "a general formula" it specifically allows for such broader substitution of the structure. When a general structure is referred to as having "the formula" it is more limited and allows only such conventional substitution as would be recognized as equivalents or by one skilled in the art (e.g., shifts wavelengths of absorbance, changes solubility, stabilizes the molecule, etc.).

As a means of simplifying the discussion and recitation of certain substituent groups, the terms 1) "group" and 2) "compound" or "moiety" are used to differentiate between those chemical species that may be substituted and those which may not be so substituted. Thus, when the term "group," such as "aryl group," is used to describe a substituent, that substituent includes the use of additional substituents beyond the literal definition of the basic group. Where the term "moiety" is used to describe a substituent, only the unsubstituted group is intended to be included. For example, the phrase, "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halogen atoms (F, Cl, Br, and I), cyano, nitro, amino, carboxy, etc. For example, alkyl group includes ether groups (e.g., $CH_3$—$CH_2$—$CH_2$—O—$CH_2$—), haloalkyls, nitroalkyls, carboxyalkyls, hydroxyalkyls, sulfoalkyls, etc. On the other hand, the phrase "alkyl moiety" is limited to the inclusion of only pure hydrocarbon alkyl chains, such as methyl, ethyl, propyl, t-butyl, cyclohexyl, iso-octyl, octadecyl, and the like. Substituents that react with active ingredients, such as very strongly electrophilic or oxidizing substituents, would of course be excluded by the ordinarily skilled artisan as not being inert or harmless.

Other aspects, advantages, and benefits of the present invention are apparent from the detailed description, examples, and claims.

DETAILED DESCRIPTION OF THE INVENTION

Chemical sensitization of photothermographic silver halide emulsions has been attempted for many years. Convention chemical sensitization treatments for wet processed silver halide emulsions have been tried unsuccessfully for photothermographic emulsions containing silver halide grains. The reasons for these failures are not completely understood, but to date, significant spectral sensitization has not been achieved, particularly in commercial quality materials. It is therefore surprising that in the practice of the present invention a novel chemical sensitization method is described which produces a significant and even high level of chemical sensitization in silver halide grains, which are observed in both wet processed photographic emulsions and dry processed photothermographic emulsions.

Applicants believe that the process of the present invention may be most broadly described as providing a sulfur-containing compound on or about the surface of silver halide grains in a silver halide photothermographic or photographic emulsion and then decomposing the sulfur-containing compound.

Decomposition of the sulfur-containing chemical sensitizing compound and/or the sources for the chemical sensitizing compounds is preferably carried out in an oxidizing environment by an oxidizing agent, preferably by a strong oxidizing agent. The oxidizing agent, and the preferably strong oxidizing agent must be strong enough to decompose the sulfur-containing compounds on the silver halide grains, and form the species that acts as the chemical sensitizer, either at ambient temperature or at temperatures up to about 40° C., preferably up to about 30° C.

The efficiency of the chemical sensitization processes is influenced by the function of the decomposing (oxidizing) agent, the sulfur-containing sensitizing compound, the length of time of the reaction, and the temperature used. For example, when pyridinium perbromide hydrobromide (hereinafter PHP) is used as the oxidizing agent to decompose the sulfur-containing compound, it is preferred to use a temperature of from about 20° C. to about 40° C., preferably from about 20° C. to about 30° C. for 30 minutes. More reactive oxidizing agents could be used at lower temperatures or for shorter periods of time (or a balance of the two), while less reactive oxidizing agents could be used at higher temperatures or for longer periods of time (or a balance of the two).

Preferred oxidizing compounds include hydrobromic acid salts of nitrogen-containing heterocyclic ring compounds which are further associated with a pair of bromine atoms. These compounds are also known as quaternary nitrogen-containing rings which are associated with hydrobromic acid (HBr)-perbromide ($Br_2$) as $HBr[Br_2]$. Compounds of this type are described in U.S. Pat. No. 5,028,523 (Skoug) incorporated herein by reference. The heterocyclic ring group may be unsubstituted or further substituted with such groups as alkyl, alkoxy, and aryl groups, halogen atoms, hydroxy groups, cyano groups, nitro groups, and the like. Exemplary and preferred heterocyclic ring groups include pyridine, pyrolidone, pyrrolidinone, pyrolidine, phthalazinone, phthalazine, etc. A particularly preferred compound is pyridinium perbromide hydrobromide (PHP).

The preferred materials for use as the sulfur-containing source or chemical sensitization compounds are compounds with sulfur atoms directly attached to cyclic rings within the structure, particularly dye structures, more preferably with at least some sulfur atoms attached or incorporated as thiocarbonyl groups (i.e., >C═S) or as —S— groups within the actual ring structure of the compounds. Compounds with both types of sulfur atom positioning [i.e., both >C═S and —S—; or —S—(C═S)—] are also desirable in the practice of the present invention.

Many of the sulfur-containing chemical sensitization precursors or compounds are either dyes or have dye-like structures. These types of sulfur-containing compounds are preferred. They are preferred because their structure apparently allows them to be distributed on the surface of the silver halide grains in an orderly and regular manner. Additionally, the mechanisms for promoting the alignment of these types of compounds on the surface of silver halide grains is well understood in the art. Furthermore, the residual products of these types of compounds are well understood for their effects or non-effects on photographic and/or photothermographic silver halide grains and emulsions. Thus, less background structural design is needed in proposing or selecting a wide range of choices for these materials from the known available supply of chemical compounds. There are also many classes and types of these compounds known to the photographic and photothermographic chemist which contain sulfur groups. Nevertheless, it is clear that certain compounds within these classes which are not dyes and are not known as dyes, may be used in the practice of the present invention to form chemically sensitized grains prior to the formation of latent images on the silver halide grains.

Particularly preferred sulfur containing chemical sensitizing compounds contain the thiohydantoin nucleus, rhodanine nucleus, and the 2-thio-4-oxo-oxazolidine nucleus. These nuclei are shown below.

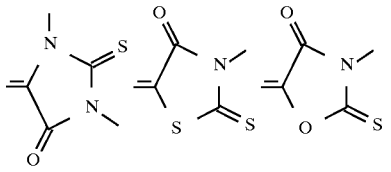

Representative sulfur containing chemical sensitizing compounds useful in the present invention and their methods of preparation and sources are known in the art. The presently preferred structures are shown below. These representations are exemplary and are not intended to be limiting.

CS-1

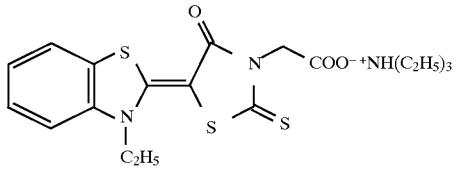

-continued

CS-2

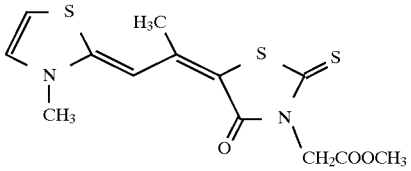

CS-3

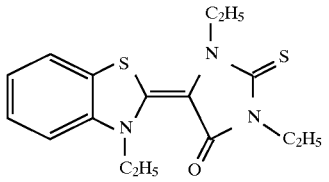

CS-4

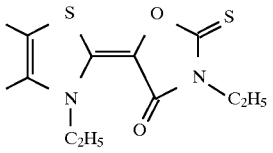

CS-5

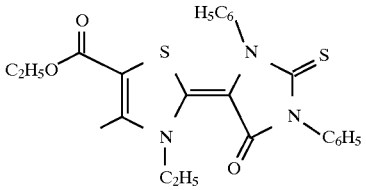

CS-6

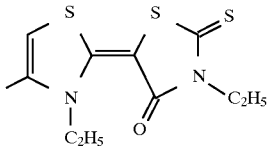

CS-7

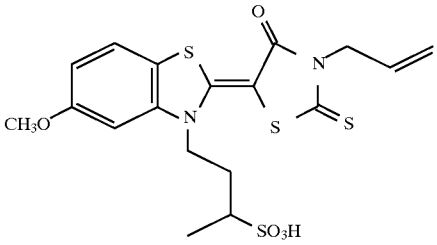

CS-8

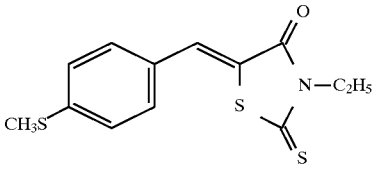

CS-9

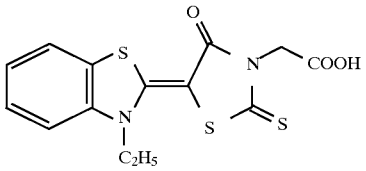

CS-10

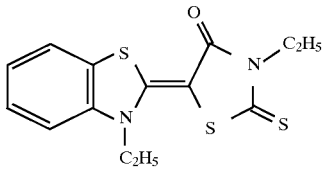

-continued

CS-11

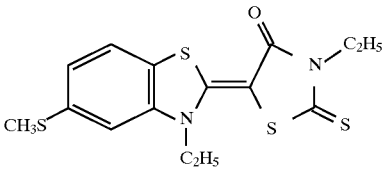

CS-12

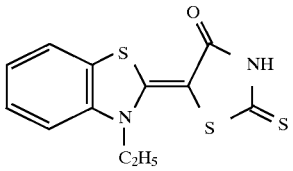

Although a specific theory can not be absolutely proposed as the basis for chemical sensitization as described in the present invention, one possible explanation is that the sulfur-containing compound may align itself along the surface of the silver halide grains as commonly occurs with efficient spectral sensitizing dyes. This ordered arrangement of dyes on the surface of the grains acts as a template for chemical sensitization. Upon decomposition of the sulfur containing sensitization precursors or compounds, the residue or reaction product of the sulfur-containing chemical compound reacts locally with the silver halide grains to provide a more ordered and efficient distribution of sensitization sites on the silver halide grains. These sites may be in a form such as silver sulfide or silver specks. The more efficient distribution of these sensitizing sites on the silver grains provides a higher speed to the emulsion.

For example, when decomposition is carried out by the preferred oxidizing agents (e.g., the PHP), they may react with the sulfur-containing compounds aligned on the surface of the silver halide grain to produce or generate a compound such as, for example, HSBr which will then in turn directly react with the surface of the silver halide grain to form the more ordered distribution of sensitization sites thereon. For the formation of compounds such as HSBr from bromine and sulfur compounds such as $H_2S$ or NaHS see M. Schmidt, J. Lowe *Angew. Chem.* 1960, 72, 79 and V. A. Rimas, A. A. Sauka *Uch. Zap. Rizhsk. Politekh. Inst.* 1965, 16, 229–203 (C.A. 1967, 67, 70148m).

The Photosensitive Silver Halide

As noted above, the present invention includes a photosensitive silver halide. The photosensitive silver halide can be any photosensitive silver halide, such as silver bromide, silver iodide, silver chloride, silver bromoiodide, silver chlorobromoiodide, silver chloroiodide, silver chlorobromide, etc. The photosensitive silver halide can be added to the emulsion layer in any fashion so long as it is placed in catalytic proximity to the organic silver compound which serves as a source of reducible silver.

The silver halide may be in any form which is photosensitive including, but not limited to cubic, octahedral, rhombic, dodecahedral, orthorhombic, tetrahedral, other polyhedral habits, etc., and may have epitaxial growth of crystals thereon.

The silver halide grains may have a uniform ratio of halide throughout; they may have a graded halide content, with a continuously varying ratio of, for example, silver bromide and silver iodide; or they may be of the core-shell-type, having a discrete core of one halide ratio, and a discrete shell of another halide ratio. Core-shell silver halide grains useful in photothermographic elements and methods of preparing these materials are described in U.S. Pat. No.

5,382,504. A core-shell silver halide grain having an iridium doped core is particularly preferred. Iridium doped core-shell grains of this type are described in U.S. Pat. No. 5,434,043.

The silver halide may be prepared ex situ, (i.e., be pre-formed) and mixed with the organic silver salt in a binder prior to use to prepare a coating solution. The silver halide may be pre-formed for addition to the photothermographic system by any means, (e.g., in accordance with U.S. Pat. No. 3,839,049). Materials of this type are often referred to as "preformed emulsions." Methods of preparing these silver halide and organic silver salts and manners of blending them are described in *Research Disclosure*, June 1978, item 17029; U.S. Pat. Nos. 3,700,458 and 4,076,539; and Japanese Patent Application Nos. 13224/74, 42529/76, and 1721675.

It is desirable in the practice of this invention with photothermographic elements to use pre-formed silver halide grains of less than 0.25 $\mu$m, and preferably less than 0.12 $\mu$m in a photothermographic element. Most preferably the number average particle size of the grains in a photothermographic element is between 0.01 and 0.09 $\mu$m. It is also preferred to use iridium doped silver halide grains and iridium doped core-shell silver halide grains as disclosed in U.S. patent application Ser. No. 08/072,153 (abandoned in favor of continuation application Ser. No. 08/297,598, pending filed Aug. 29, 1994; continuation-in-part application Ser. No. 08/314,211, pending filed Sep. 28, 1994; and divisional application Ser. No. 08/822,200, pending filed Mar. 20, 1997) and U.S. Pat. No. 5,434,043 described above.

Pre-formed silver halide emulsions when used in the element of this invention can be unwashed or washed to remove soluble salts. In the latter case, the soluble salts can be removed by chill-setting and leaching or the emulsion can be coagulation washed, e.g., by the procedures described in U.S. Pat. Nos. 2,618,556; 2,614,928; 2,565,418; 3,241,969; and 2,489,341.

It is also effective to use an in situ process (i.e., a process in which a halogen-containing compound is added to an organic silver salt to partially convert the silver of the organic silver salt to silver halide).

The light sensitive silver halide used in the present invention can be employed in a range of about 0.005 mole to about 0.5 mole; preferably, from about 0.01 mole to about 0.15 mole per mole; and more preferably, from 0.03 mole to 0.12 mole per mole of non-photosensitive reducible silver salt, or in other parameters from 0.5 to 15% by weight of the emulsion (light sensitive layer), preferably from 1 to 10% by weight of said emulsion layer.

Supersensitizers

To get the speed of the photothermographic elements up to maximum levels and further enhance sensitivity, it is often desirable to use supersensitizers. Any supersensitizer can be used which increases the sensitivity. For example, preferred infrared supersensitizers are described in U.S. patent application Ser. No. 08/091,000 (filed Jul. 13, 1993) and include heteroaromatic mercapto compounds or heteroaromatic disulfide compounds of the formula:

Ar—S—M

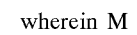

Ar—S—S—Ar wherein M represents a hydrogen atom or an alkali metal atom.

In the above noted supersensitizers, Ar represents a heteroaromatic ring or fused heteroaromatic ring containing one or more of nitrogen, sulfur, oxygen, selenium or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline or quinazolinone. However, other heteroaromatic rings are envisioned under the breadth of this invention.

The heteroaromatic ring may also carry substituents with examples of preferred substituents being selected from the group consisting of halogen (e.g., Br and Cl), hydroxy, amino, carboxy, alkyl (e.g., of 1 or more carbon atoms, preferably 1 to 4 carbon atoms) and alkoxy (e.g., of 1 or more carbon atoms, preferably of 1 to 4 carbon atoms.

Most preferred supersensitizers are 2-mercaptobenzimidazole, 2-mercapto-5-methylbenzimidazole (MMBI), 2-mercaptobenzothiazole, and 2-mercapto-benzoxazole (MBO).

The supersensitizers are used in general amount of at least 0.001 moles of sensitizer per mole of silver in the emulsion layer. Usually the range is between 0.001 and 1.0 moles of the compound per mole of silver and preferably between 0.01 and 0.3 moles of compound per mole of silver.

The Non-Photosensitive Reducible Silver Source

The present invention includes a non-photosensitive reducible silver source. The non-photosensitive reducible silver source that can be used in the present invention can be any compound that contains a source of reducible silver ions. Preferably, it is a silver salt which is comparatively stable to light and forms a silver image when heated to 80° C. or higher in the presence of an exposed photocatalyst (such as silver halide) and a reducing agent.

Silver salts of organic acids, particularly silver salts of long chain fatty carboxylic acids, are preferred. The chains typically contain 10 to 30, preferably 15 to 28, carbon atoms. Suitable organic silver salts include silver salts of organic compounds having a carboxyl group. Examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate, silver camphorate, and mixtures thereof, etc. Silver salts that can be substituted with a halogen atom or a hydroxyl group also can be effectively used. Preferred examples of the silver salts of aromatic carboxylic acid and other carboxyl group-containing compounds include: silver benzoate, a silver-substituted benzoate, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc.; silver gallate; silver tannate; silver phthalate; silver terephthalate; silver salicylate; silver phenylacetate; silver pyromellitate; a silver salt of 3-carboxymethyl-4-methyl-4-thiazoline-2-thione or the like as described in U.S. Pat. No. 3,785,830; and a silver salt of an aliphatic carboxylic acid containing a thioether group as described in U.S. Pat. No. 3,330,663. Soluble silver carboxylates having increased solubility in coating solvents and affording coatings with less light scattering can also be used. Such silver carboxylates are described in U.S. Pat. No. 5,491,059.

Silver salts of compounds containing mercapto or thione groups and derivatives thereof can also be used. Preferred examples of these compounds include: a silver salt of 3-mercapto-4-phenyl-1,2,4-triazole; a silver salt of 2-mercaptobenzimidazole; a silver salt of 2-mercapto-5-aminothiadiazole; a silver salt of 2-(2-ethylglycolamido) benzothiazole; a silver salt of thioglycolic acid, such as a silver salt of a S-alkylthioglycolic acid (wherein the alkyl group has from 12 to 22 carbon atoms); a silver salt of a dithiocarboxylic acid such as a silver salt of dithioacetic acid; a silver salt of thioamide; a silver salt of 5-carboxylic-1-methyl-2-phenyl-4-thiopyridine; a silver salt of mercaptotriazine; a silver salt of 2-mercaptobenzoxazole; a silver salt as described in U.S. Pat. No. 4,123,274, for example, a silver salt of a 1,2,4-mercaptothiazole derivative, such as a silver salt of 3-amino-5-benzylthio-1,2,4-thiazole; and a silver salt of a thione compound, such as a silver salt of 3-(2-carboxyethyl)-4-methyl-4-thiazoline-2-thione as disclosed in U.S. Pat. No. 3,201,678.

Furthermore, a silver salt of a compound containing an imino group can be used. Preferred examples of these compounds include: silver salts of benzotriazole and substituted derivatives thereof, for example, silver methylbenzotriazole and silver 5-chlorobenzotriazole, etc.; silver salts of 1,2,4-triazoles or 1-H-tetrazoles as described in U.S. Pat. No. 4,220,709; and silver salts of imidazoles and imidazole derivatives.

Silver salts of acetylenes can also be used. Silver acetylides are described in U.S. Pat. Nos. 4,761,361 and 4,775,613.

It is also found convenient to use silver half soaps. A preferred example of a silver half soap is an equimolar blend of silver behenate and behenic acid, which analyzes for about 14.5% by weight solids of silver in the blend and which is prepared by precipitation from an aqueous solution of the sodium salt of commercial behenic acid.

Transparent sheet elements made on transparent film backing require a transparent coating. For this purpose a silver behenate full soap, containing not more than about 15% of free behenic acid and analyzing about 22% silver, can be used.

The method used for making silver soap emulsions is well known in the art and is disclosed in *Research Disclosure*, April 1983, item 22812, *Research Disclosure*, October 1983, item 23419, and U.S. Pat. No. 3,985,565.

The silver halide and the non-photosensitive reducible silver source that form a starting point of development should be in catalytic proximity (i.e., reactive association). "Catalytic proximity" or "reactive association" means that they should be in the same layer, in adjacent layers, or in layers separated from each other by an intermediate layer having a thickness of less than 1 micrometer (1 $\mu$m). It is preferred that the silver halide and the non-photosensitive reducible silver source be present in the same layer.

The source of reducible silver generally constitutes about 5 to about 70% by weight of the emulsion layer. It is preferably present at a level of about 10 to about 50% by weight of the emulsion layer.

The Reducing Agent for the Non-Photosensitive Reducible Silver Source

When used in black-and-white photothermographic elements, the reducing agent for the organic silver salt may be any compound, preferably organic compound, that can reduce silver ion to metallic silver. Conventional photographic developers such as phenidone, hydroquinones, and catechol are useful, but hindered bisphenol reducing agents are preferred.

A wide range of reducing agents has been disclosed in dry silver systems including amidoximes, such as phenylamidoxime, 2-thienylamidoxime and p-phenoxyphenylamidoxime; azines, such as 4-hydroxy-3,5-dimethoxybenzaldehydeazine; a combination of aliphatic carboxylic acid aryl hydrazides and ascorbic acid, such as 2,2'-bis(hydroxymethyl)propionyl-β-phenylhydrazide in combination with ascorbic acid; a combination of polyhydroxybenzene and hydroxylamine; a reductone and/or a hydrazine, such as a combination of hydroquinone and bis(ethoxyethyl)hydroxylamine, piperidinohexose reductone, or formyl-4-methylphenylhydrazine; hydroxamic acids, such as phenylhydroxamic acid, p-hydroxyphenylhydroxamic acid, and o-alaninehydroxamic acid; a combination of azines and sulfonamidophenols, such as phenothiazine with p-benzenesulfonamidophenol or 2,6-dichloro-4-benzenesulfonamidophenol; α-cyanophenylacetic acid derivatives, such as ethyl α-cyano-2-methylphenylacetate, ethyl α-cyano-phenylacetate; a combination of bis-o-naphthol and a 1,3-dihydroxybenzene derivative, such as 2,4-dihydroxybenzophenone or 2,4-dihydroxyacetophenone; 5-pyrazolones such as 3-methyl-1-phenyl-5-pyrazolone; reductones, such as dimethylaminohexose reductone, anhydrodihydroaminohexose reductone, and anhydrodihydropiperidone-hexose reductone; sulfonamidophenol reducing agents, such as 2,6-dichloro-4-benzenesulfonamidophenol and p-benzenesulfonamidophenol; indane-1,3-diones, such as 2-phenylindane-1,3-dione; chromans, such as 2,2-dimethyl-7-t-butyl-6-hydroxychroman; 1,4-dihydropyridines, such as 2,6-dimethoxy-3,5-dicarbethoxy-1,4-dihydropyridine; ascorbic acid derivatives, such as 1-ascorbylpalmitate, ascorbylstearate; unsaturated aldehydes and ketones; certain 1,3-indanediones, and 3-pyrazolidones (phenidones).

Hindered bisphenol developers are compounds that contain only one hydroxy group on a given phenyl ring and have at least one additional substituent located ortho to the hydroxy group. They differ from traditional photographic developers which contain two hydroxy groups on the same phenyl ring (such as is found in hydroquinones). Hindered phenol developers may contain more than one hydroxy group as long as they are located on different phenyl rings. Hindered phenol developers include, for example, binaphthols (i.e., dihydroxybinaphthyls), biphenols (i.e., dihydroxybiphenyls), bis(hydroxynaphthyl)methanes, bis(hydroxyphenyl)methanes, hindered phenols, and naphthols.

Non-limiting representative bis-o-naphthols, such as by 2,2'-dihydroxyl-1-binaphthyl, 6,6'-dibromo-2,2'-dihydroxy-1,1'-binaphthyl, and bis(2-hydroxy-1-naphthyl)methane. For additional compounds see U.S. Pat. No. 5,262,295 at column 6, lines 12–13, incorporated herein by reference.

Non-limiting representative biphenols include 2,2'-dihydroxy-3,3'-di-t-butyl-5,5-dimethylbiphenyl; 2,2'-dihydroxy-3,3',5,5'-tetra-t-butylbiphenyl; 2,2'-dihydroxy-3,3'-di-t-butyl-5,5'-dichlorobiphenyl; 2-(2-hydroxy-3-t-butyl-5-methylphenyl)-4-methyl-6-n-hexylphenol; 4,4'-dihydroxy-3,3',5,5'-tetra-t-butyl-biphenyl; and 4,4'-dihydroxy-3,3',5,5'-tetramethylbiphenyl. For additional compounds see U.S. Pat. No. 5,262,295 at column 4, lines 17–47, incorporated herein by reference.

Non-limiting representative bis(hydroxynaphthyl) methanes include 2,2'-methylene-bis(2-methyl-1-naphthol) methane. For additional compounds see U.S. Pat. No. 5,262,295 at column 6, lines 14–16, incorporated herein by reference.

Non-limiting representative bis(hydroxyphenyl)methanes include bis(2-hydroxy-3-t-butyl-5-methylphenyl)methane (CAO-5); 1,1-bis(2-hydroxy-3,5-dimethylphenyl)-3,5,5-trimethylhexane (Permanex™ or Nonox™); 1,1'-bis(3,5-tetra-t-butyl-4-hydroxy)methane; 2,2-bis(4-hydroxy-3-methylphenyl)propane; 4,4-ethylidene-bis(2-t-butyl-6-methylphenol); and 2,2-bis(3,5-dimethyl-4-hydroxyphenyl) propane. For additional compounds see U.S. Pat. No. 5,262,295 at column 5 line 63 to column 6, line 8 incorporated herein by reference.

Non-limiting representative hindered phenols include 2,6-di-t-butylphenol; 2,6-di-t-butyl-4-methylphenol; 2,4-di-t-butylphenol; 2,6-dichlorophenol; 2,6-dimethylphenol; and 2-t-butyl-6-methylphenol.

Non-limiting representative hindered naphthols include 1-naphthol; 4-methyl-1-naphthol; 4-methoxy-1-naphthol; 4-chloro-1-naphthol; and 2-methyl-1-naphthol. For additional compounds see U.S. Pat. No. 5,262,295 at column 6, lines 17–20, incorporated herein by reference.

The reducing agent should be present as 1 to 15% by weight of the imaging layer. In multilayer elements, if the reducing agent is added to a layer other than an emulsion layer, slightly higher proportions, of from about 2 to 20%, tend to be more desirable.

Photothermographic elements of the invention may contain contrast enhancers, co-developers or mixtures thereof. For example, the trityl hydrazide or formyl phenylhydrazine compounds described in U.S. Pat. No. 5,496,695 may be used; the amine compounds described in U.S. Pat. No. 5,545,505 may be used; hydroxamic acid compounds described in U.S. Pat. No. 5,545,507 may be used; the acrylonitrile compounds described in U.S. Pat. No. 5,545,515 may be used; the N-acyl-hydrazide compounds as described in U.S. Pat. No. 5,558,983 may be used; the 2-substituted malondialdehyde compounds described in U.S. Pat. No. 5,705,324; the 4-substituted isoxazole compounds described in U.S. Pat. No. 5,654,130; the 3-heteroaromatic-substituted acrylonitrile compounds described in U.S. Pat. No. 5,635,339; and the hydrogen atom donor compounds described in U.S. Pat. No. 5,673,449 may be used;

Further, the reducing agent may optionally comprise a compound capable of being oxidized to form or release a dye. Preferably the dye-forming material is a leuco dye.

Photothermographic elements of the invention may also contain other additives such as shelf-life stabilizers, toners, development accelerators, acutance dyes, post-processing stabilizers or stabilizer precursors, and other image-modifying agents.

The Binder

The photosensitive silver halide, the non-photosensitive reducible source of silver, the reducing agent, and any other addenda used in the present invention are generally added to at least one binder. The binder(s) that can be used in the present invention can be employed individually or in combination with one another. It is preferred that the binder be selected from polymeric materials, such as, for example, natural and synthetic resins that are sufficiently polar to hold the other ingredients in solution or suspension.

A typical hydrophilic binder is a transparent or translucent hydrophilic colloid. Examples of hydrophilic binders include: a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as polyvinyl alcohol, polyvinyl pyrrolidone, acrylamide polymer, etc. Another example of a hydrophilic binder is a dispersed vinyl compound in latex form which is used for the purpose of increasing dimensional stability of a photographic element.

Examples of typical hydrophobic binders are polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers (e.g., terpolymers), are also included in the definition of polymers. The polyvinyl acetals, such as polyvinyl butyral and polyvinyl formal, and vinyl copolymers such as polyvinyl acetate and polyvinyl chloride are particularly preferred.

Although the binder can be hydrophilic or hydrophobic, preferably it is hydrophobic in the silver containing layer(s). Optionally, these polymers may be used in combination of two or more thereof.

The binders are preferably used at a level of about 30–90% by weight of the emulsion layer, and more preferably at a level of about 45–85% by weight. Where the proportions and activities of the reducing agent for the non-photosensitive reducible source of silver require a particular developing time and temperature, the binder should be able to withstand those conditions. Generally, it is preferred that the binder not decompose or lose its structural integrity at 250° F. (121° C.) for 60 seconds, and more preferred that it not decompose or lose its structural integrity at 350° F. (177° C.) for 60 seconds.

The polymer binder is used in an amount sufficient to carry the components dispersed therein, that is, within the effective range of the action as the binder. The effective range can be appropriately determined by one skilled in the art.

Photothermographic Formulations

The formulation for the photothermographic emulsion layer can be prepared by dissolving and dispersing the binder, the photosensitive silver halide, the non-photosensitive reducible source of silver, the reducing agent for the non-photosensitive reducible silver source, and optional additives, in an inert organic solvent, such as, for example, toluene, 2-butanone, or tetrahydrofuran.

The use of "toners" or derivatives thereof which improve the image, is highly desirable, but is not essential to the element. Toners can be present in an amount of about 0.01–10% by weight of the emulsion layer, preferably about 0.1–10% by weight. Toners are well known compounds in the photothermographic art, as shown in U.S. Pat. Nos. 3,080,254; 3,847,612; and 4,123,282.

Examples of toners include: phthalimide and N-hydroxyphthalimide; cyclic imides, such as succinimide, pyrazoline-5-ones, quinazolinone, 1-phenylurazole, 3-phenyl-2-pyrazoline-5-one, and 2,4-thiazolidinedione; naphthalimides, such as N-hydroxy-1,8-naphthalimide; cobalt complexes, such as cobaltic hexamine trifluoroacetate; mercaptans such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, such as (N,N-dimethylaminomethyl)phthalimide, and N-(dimethylaminomethyl)naphthalene-2,3-dicarboximide; a combination of blocked pyrazoles, isothiuronium derivatives, and certain photobleach agents, such as a combination of N,N'-hexamethylene-bis(1-carbamoyl-3,5-dimethylpyrazole), 1,8-(3,6-diazaoctane)bis(isothiuronium) trifluoroacetate, and 2-(tribromomethylsulfonyl benzothiazole); merocyanine dyes such as 3-ethyl-5-[(3-ethyl-2-benzothiazolinylidene)-1-methyl-ethylidene]-2-thio-2,4-o-azolidinedione; phthalazinone, phthalazinone derivatives, or metal salts or these derivatives, such as 4-(1-naphthyl)phthalazinone, 6-chlorophthalazinone, 5,7-dimethoxyphthalazinone, and 2,3-dihydro-1,4-phthalazinedione; a combination of phthalazine plus one or more phthalic acid derivatives, such as phthalic acid, 4-methylphthalic acid, 4-nitrophthalic acid, and tetrachlorophthalic anhydride, quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate, and potassium hexachlororhodate (III); inorganic peroxides and persulfates, such as ammonium peroxydisulfate and hydrogen peroxide; benzoxazine-2,4-diones, such as 1,3-benzoxazine-2,4-dione, 8-methyl-1,3-benzoxazine-2,4-dione, and 6-nitro-1,3-benzoxazine-2,4-dione; pyrimidines and asym-triazines, such as 2,4-dihydroxypyrimidine, 2-hydroxy4-aminopyrimidine, and azauracil; and tetraazapentalene derivatives, such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene.

The photothermographic elements used in this invention can be further protected against the production of fog and can be further stabilized against loss of sensitivity during storage. While not necessary for the practice of the invention, it may be advantageous to add mercury (II) salts to the emulsion layer(s) as an antifoggant. Preferred mercury (H) salts for this purpose are mercuric acetate and mercuric bromide.

Other suitable antifoggants and stabilizers, which can be used alone or in combination include the thiazolium salts described in U.S. Pat. Nos. 2,131,038 and U.S. Pat. No. 2,694,716; the azaindenes described in U.S. Pat. No. 2,886,437; the triazaindolizines described in U.S. Pat. No. 2,444,605; the mercury salts described in U.S. Pat. No. 2,728,663; the urazoles described in U.S. Pat. No. 3,287,135; the sulfocatechols described in U.S. Pat. No. 3,235,652; the oximes described in British Patent No. 623,448; the polyvalent metal salts described in U.S. Pat. No. 2,839,405; the thiuronium salts described in U.S. Pat. No. 3,220,839; palladium, platinum and gold salts described in U.S. Pat. Nos. 2,566,263 and 2,597,915; and the 2-(tribromomethylsulfonyl)quinoline compounds described in U.S. Pat. No. 5,460,938. Stabilizer precursor compounds capable of releasing stabilizers upon application of heat during development can also be use in combination with the stabilizers of this invention. Such precursor compounds are described in, for example, U.S. Pat. Nos. 5,158,866, 5,175,081, 5,298,390, and 5,300,420.

Photothermographic elements of the invention can contain plasticizers and lubricants such as polyalcohols and diols of the type described in U.S. Pat. No. 2,960,404; fatty acids or esters, such as those described in U.S. Pat. Nos. 2,588,765 and 3,121,060; and silicone resins, such as those described in British Patent No. 955,061.

Photothermographic elements containing emulsion layers described herein may contain matting agents such as starch, titanium dioxide, zinc oxide, silica, and polymeric beads including beads of the type described in U.S. Pat. Nos. 2,992,101 and 2,701,245.

Emulsions in accordance with this invention may be used in photothermographic elements which contain antistatic or conducting layers, such as layers that comprise soluble salts (e.g., chlorides, nitrates, etc.), evaporated metal layers, ionic polymers such as those described in U.S. Pat. Nos. 2,861,056, and 3,206,312 or insoluble inorganic salts such as those described in U.S. Pat. No. 3,428,451.

The photothermographic elements of this invention may also contain electroconductive under-layers to reduce static electricity effects and improve transport through processing equipment. Such layers are described in U.S. Pat. No. 5,310,640.

Photothermographic Constructions

The photothermographic elements of this invention may be constructed of one or more layers on a support. Single layer elements should contain the silver halide, the non-photosensitive, reducible silver source, the reducing agent for the non-photosensitive reducible silver source, the binder as well as optional materials such as toners, acutance dyes, coating aids, and other adjuvants.

Two-layer constructions (often referred to as two-trip constructions because of the coating of two distinct layers on the support) should contain silver halide and non-photosensitive, reducible silver source in one emulsion layer (usually the layer adjacent to the support) and some of the other ingredients in the second layer or both layers. Two layer constructions comprising a single emulsion layer coating containing all the ingredients and a protective topcoat are also envisioned.

Multicolor photothermographic dry silver elements can contain sets of these bilayers for each color or they can contain all ingredients within a single layer, as described in U.S. Pat. No. 4,708,928.

Barrier layers, preferably comprising a polymeric material, can also be present in the photothermographic element of the present invention. Polymers for the barrier layer can be selected from natural and synthetic polymers such as gelatin, polyvinyl alcohols, polyacrylic acids, sulfonated polystyrene, and the like. The polymers can optionally be blended with barrier aids such as silica.

Photothermographic emulsions used in this invention can be coated by various coating procedures including wire wound rod coating, dip coating, air knife coating, curtain coating, slide coating, or extrusion coating using hoppers of the type described in U.S. Pat. No. 2,681,294. If desired, two or more layers can be coated simultaneously by the procedures described in U.S. Pat. Nos. 2,761,791; 5,340,613; and British Patent No. 837,095. A typical coating gap for the emulsion layer can be about 10–150 micrometers ($\mu$m), and the layer can be dried in forced air at a temperature of about 20–100° C. It is preferred that the thickness of the layer be selected to provide maximum image densities greater than 0.2, and, more preferably, in the range 0.5 to 4.5, as measured by a MacBeth Color Densitometer Model TD 504 using the color filter complementary to the dye color.

Photothermographic elements according to the present invention can contain acutance dyes and antihalation dyes. The dyes may be incorporated into the photothermographic emulsion layer as acutance dyes according to known techniques. The dyes may also be incorporated into antihalation layers according to known techniques as an antihalation backing layer, an antihalation underlayer or as an overcoat. It is preferred that the photothermographic elements of this invention contain an antihalation coating on the support opposite to the side on which the emulsion and topcoat layers are coated. Antihalation and acutance dyes useful in the present invention are described in U.S. Pat. Nos. 5,135,842; 5,226,452; 5,314,795, and 5,380,635.

Development conditions will vary, depending on the construction used, but will typically involve heating the photothermographic element in a substantially water-free condition after, or simultaneously with, imagewise exposure at a suitably elevated temperature. Thus, the latent image obtained after exposure can be developed by heating the element at a moderately elevated temperature of, from about 80° C. to about 250° C. (176° F. to 482° F.), preferably from about 100° C. to about 200° C. (212° F. to 392° F.), for a sufficient period of time, generally about 1 second to about 2 minutes. When used in a black-and-white element, a black-and-white silver image is obtained. When used in a monochrome or full-color element, a dye image is obtained simultaneously with the formation of a black-and-white silver image. Heating may be carried out by the typical heating means such as an oven, a hot plate, an iron, a hot roller, a heat generator using carbon or titanium white, or the like.

If desired, the imaged element may be subjected to a first heating step at a temperature and for a time sufficient to intensify and improve the stability of the latent image but insufficient to produce a visible image and later subjected to a second heating step at a temperature and for a time sufficient to produce the visible image. Such a method and its advantages are described in U.S. Pat. No. 5,279,928.

The Support

Photothermographic emulsions used in the invention can be coated on a wide variety of supports. The support, or substrate, can be selected from a wide range of materials depending on the imaging requirement. Supports may be transparent or at least translucent. Typical supports include polyester film, subbed polyester film (e.g., polyethylene terephthalate or polyethylene naphthalate), cellulose acetate film, cellulose ester film, polyvinyl(e.g., film, polyolefinic film (e.g., polyethylene or polypropylene or blends thereof), polycarbonate film and related or resinous materials, as well as glass, paper, and the like. Typically, a flexible support is employed, especially a polymeric film support, which can be partially acetylated or coated, particularly with a polymeric subbing or priming agent. Preferred polymeric materials for the support include polymers having good heat stability, such as polyesters. Particularly preferred polyesters are polyethylene terephthalate and polyethylene naphthalate.

A support with a backside resistive heating layer can also be used photothermographic imaging systems such as shown in U.S. Pat. No. 4,374,921.

Use as a Photomask

The possibility of low absorbance of the photothermographic element in the range of 350–450 nm in non-imaged areas facilitates the use of the photothermographic elements of the present invention in a process where there is a subsequent exposure of an ultraviolet or short wavelength visible radiation sensitive imageable medium. For example, imaging the photothermographic element with coherent radiation and subsequent development affords a visible image. The developed photothermographic element absorbs ultraviolet or short wavelength visible radiation in the areas where there is a visible image and transmits ultraviolet or short wavelength visible radiation where there is no visible image. The developed element may then be used as a mask and placed between an ultraviolet or short wavelength visible radiation energy source and an ultraviolet or short wavelength visible radiation photosensitive imageable medium such as, for example, a photopolymer, diazo compound, or photoresist. This process is particularly useful where the imageable medium comprises a printing plate and the photothermographic element serves as an imagesetting film.

Objects and advantages of this invention will now be illustrated by the following examples, but the particular materials and amounts thereof recited in these examples, as well as other conditions and details, should not be construed to unduly limit this invention.

EXAMPLES

All materials used in the following examples are readily available from standard commercial sources, such as Aldrich Chemical Co. (Milwaukee, Wis.). All percentages are by weight unless otherwise indicated. The following additional terms and materials were used.

Acryloid™ A-21 is a poly(methyl methacrylate) polymer available from Rohm and Haas, Philadelphia, Pa.

Butvar™ B-79 is a poly(vinyl butyral) resins available from Monsanto Company, St. Louis, Mo.

BZT is benzotriazole.

CAB 171-15S and CAB 381-20 are cellulose acetate butyrate polymers available from Eastman Chemical Co., Kingsport, Tenn.

CBBA is 2-(4-chlorobenzoyl)benzoic acid.

MBO is 2-mercaptobenzoxazole. It is a supersensitizer.

MEK is methyl ethyl ketone (2-butanone).

MMBI is 5-methyl-2-mercaptobenzimidazole. It is a supersensitizer.

4-MPA is 4-methylphthalic acid.

NonoX™ is 1,1-bis(2-hydroxy-3,5-dimethylphenyl)-3,5,5-trimethylhexane [CAS RN=7292-14-0] and is available from St. Jean PhotoChemicals, Inc., Quebec. It is a hindered phenol reducing agent (i.e., a developer) for the non-photosensitive reducible source of silver. It is also known as Permanax™ WSO.

Vitel™ PE-2200 is a polyester resin available from Shell, Houston Tex.

PET is polyethylene terephthalate.

PHZ is phthalazine.

PHP is pyridinium hydrobromide perbromide.

#810 Scotch™ Brand Tape is available from 3M Company, St. Paul, Minn.

TCPAN is tetrachlorophthalic anhydride.

TCPA is tetrachlorophthalic acid.

THDI is Desmodur™ N-3300, a biuretized hexamethylenediisocyanate available from Bayer Chemical Corporation.

Vinol 523 is a polyvinyl alcohol available from Air Products, Allentown, Pa.

Antifoggant 1 (AF-1) is 2-(tribromomethylsulfonyl) quinoline. It is described in U.S. Pat. No. 5,460,938 and has the structure shown below.

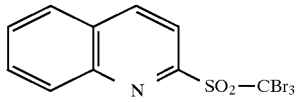

Fluorinated Terpolymer A (FT-A) has the following random polymer structure, where m=7, n=2 and p=1. The preparation of fluorinated terpolymer A is described in U.S. Pat. No. 5,380,644.

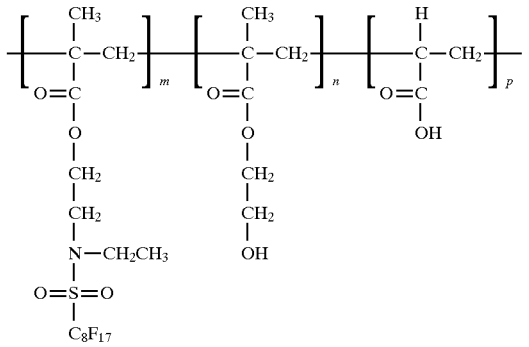

Spectral Sensitizing Dye-1 (SSD-1) is described in U.S. Pat. No. 5,541,054 and has the structure shown below.

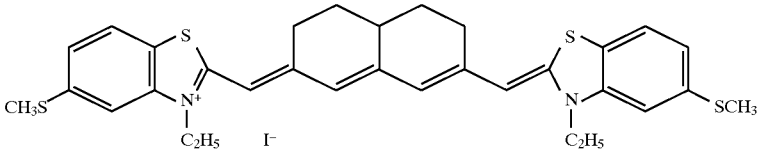

SSD-1

Spectral Sensitizing Dye-2 (SSD-2) has the structure shown below.

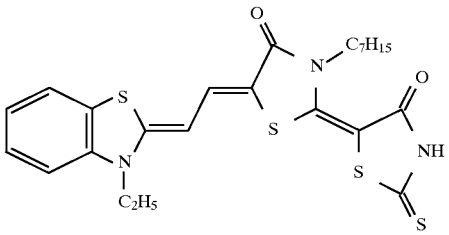

SSD-2

Spectral Sensitizing Dye-3 (SSD-3) has the structure shown below.

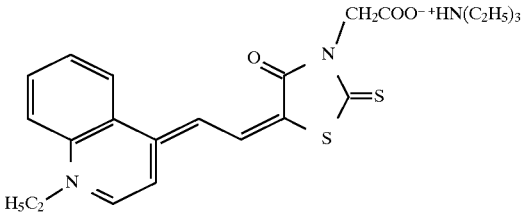

SSD-3

Spectral Sensitizing Dye-4 (SSD-4) has the structure shown below.

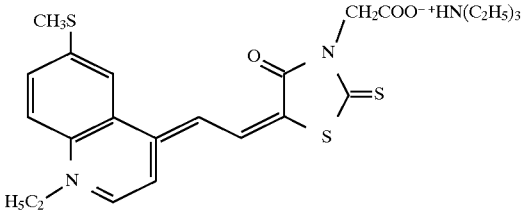

SSD-4

Spectral Sensitizing Dye-5 (SSD-5) has the structure shown below.

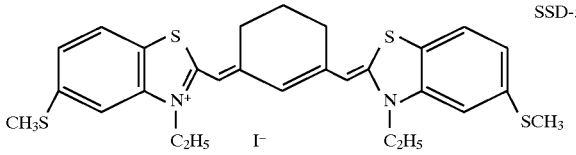

SSD-5

Spectral Sensitizing Dye-6 (SSD-6) has the structure shown below.

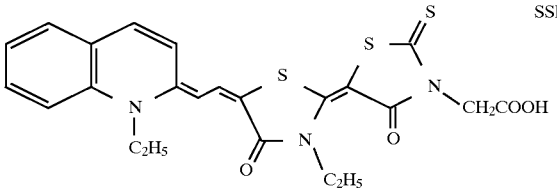

SSD-6

Spectral Sensitizing Dye-7 (SSD-7) has the structure shown below.

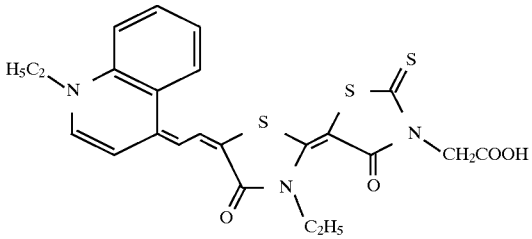

SSD-7

Spectral Sensitizing Dye-8 (SSD-8) has the structure shown below.

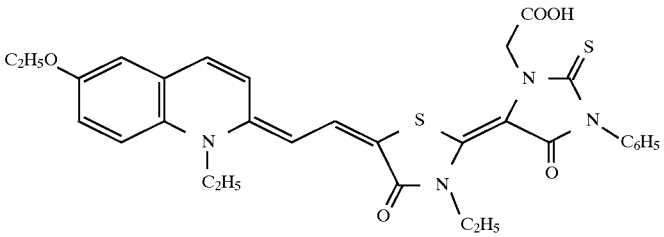

SSD-8

Compounds CN-02 and CN-08 are described in U.S. Pat. No. 5,545,515 and have the structures shown below.

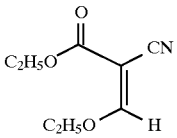

CN-02

-continued

CN-08

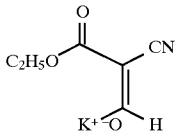

Compounds PR-01 and PR-08 are described in U.S. Pat. No. 5,686,228 and have the structures shown below.

PR-01

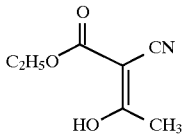

Antihalation Dye-1 (AH Dye-1) is described in Example 1f of U.S. Pat. No. 5,380,635 and has the structure shown below.

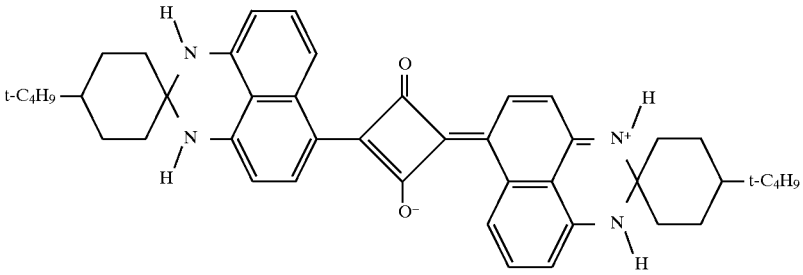

Antihalation Dye-2 (AH Dye-2) is described in PCT Publication No. WO 95/23357 and has the structure shown below.

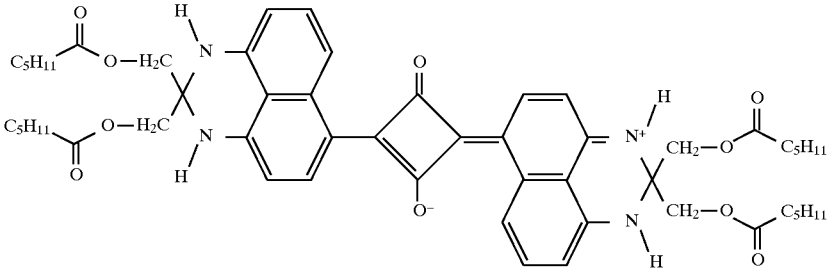

Vinyl Sulfone-1 (VS-1) is described in European Laid Open Patent Application No. 0 600 589 A2 and has structure shown below.

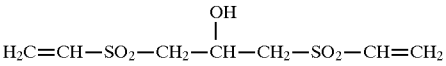

The photothermographic emulsion and topcoat were coated using a dual knife coater. This apparatus consists of two hinged knife-coating blades in series. After raising the hinged knives the support was placed in position on the coater bed. The knives were then lowered and locked into place. The height of the knives was adjusted with wedges controlled by screw knobs and measured with electronic gauges. Knife #1 was raised to a clearance corresponding to the thickness of the support plus the desired coating gap for the emulsion layer (layer #1). Knife #2 was raised to a height equal to the desired thickness of the support plus the desired coating gap for the emulsion layer (layer #1) plus the desired coating gap for the topcoat layer (layer #2).

Aliquots of photothermographic emulsion #1 and topcoat #2 were simultaneously poured onto the support in front of the corresponding knives. The support was immediately drawn past the knives and into an oven to produce a double layered coating. The coated photothermographic or thermographic element was then dried by taping the support to a belt which was rotated inside a BlueM™ oven.

Photothermographic emulsion and topcoat formulations were coated onto a polyethylene terephthalate (PET) support provided with an antihalation coating on the back side of the support. All formulations and samples were prepared and coated using safelights appropriate to the wavelengths of spectral sensitivity of the photothermographic emulsions.

Sensitometric Measurements: The images obtained were evaluated on custom built computer scanned densitometers using a filter appropriate to the sensitivity of the photothermographic element (when required) and are believed to be comparable to measurements from commercially available densitometers.

Examples 1–4

Sensitometry measurements made in Examples 1–4 use the definitions shown below. Sensitometric results include Dmin, Dmax, Speed-2, Speed-3, Average Contrast-1, and Average Contrast-3.

Dmin is the density of the non-exposed areas after development. It is the average of eight lowest density values on the exposed side of the fiducial mark.

Dmax is the highest density value on the exposed side of the fiducial mark.

Speed-2 is the Log (1/E)+4 corresponding to the density value at 1.00 above Dmin. E is the exposure in ergs/cm$^2$.

Speed-3 is the Log (1/E)+4 corresponding to the density value at 2.90 above Dmin. E is the exposure in ergs/cm$^2$. Speed-3 is important in evaluating the exposure response of a photothermographic element to high intensity light sources.

AC-1 (Average Contrast 1) is the absolute value of the slope of the line joining the density points at 0.60 and 2.00 above Dmin.

AC-3 (Average Contrast 3) is the absolute value of the slope of the line joining the density points at 2.40 and 2.90 above Dmin.

Example 1

Photothermographic Emulsion A

A pre-formed iridium-doped core-shell silver behenate full soap was prepared as described in U.S. Pat. No. 5,434,043 incorporated herein by reference.

The pre-formed soap contained 2.0 wt % of a 0.05 μm diameter iridium-doped core-shell silver iodobromide emulsion (25% core containing 8% iodide, 92% bromide; and 75% all bromide shell containing $1\times10^{-5}$ mol of iridium). A dispersion of this silver behenate full soap was homogenized to 21.9% solids in 2-butanone containing 1.3% Butvar™ B-79 polyvinyl butyral resin.

To 208 g of this full silver soap dispersion, maintained at 22° C. and rapidly stirred at 1000 rpm, was added a solution of 0.02 g of chemical sensitizing compound CS-1 dissolved in 4 g of methanol.

After stirring for 30 minutes 0.20 g of pyridinium hydrobromide perbromide dissolved in 1 mL of methanol was added. After 60 minutes, a solution of 0.10 g of $CaBr_2.xH_2O$ or $CaBr_2.2H_2O$ dissolved in 1.0 mL of methanol was added. Mixing for 30 minutes was followed by addition of a solution of 0.128 g of MMBI and 1.42 g of CBBA in 5 g of methanol.

The solution was then cooled to 12.8° C. (55° F.) and 40 g of Butvar™ B-79 was added. Stirring for 30 minutes was followed by addition of a solution of 1.10 g of Antifoggant-1 (AF-1) dissolved in 15 mL of 2-butanone. After 15 minutes, 10.45 g of Nonox™ was added. After 15 minutes 0.28 g of THDI was added. Finally, after 15 minutes, 0.85 g of PHZ and 0.36 g of TCPA were added.

The mixture was then warmed to 22° C. and 0.45 g 4-MPA in 4 g of methanol was added and stirred for 15 minutes.

A topcoat solution was then prepared in the following manner; 4.5 g Acryloid™ A-21 and 115 g of CAB 171-15S were mixed until dissolved in 1,236 g 2-butanone and 147 g of methanol. To 100 g of this stock solution was added 0.515 g of Fluorinated Terpolymer A (FT-A).

A second photothermographic emulsion and topcoat were prepared but without incorporating any CS-1 into the photothermographic emulsion layer. This sample (1–2) served as a control.

The photothermographic emulsion and topcoat formulations were coated onto a 7 mil (176 μm) blue tinted polyethylene terephthalate support provided with an antihalation back-coating containing AH Dye-1 in CAB 381-20 resin. The coating gap for the photothermographic emulsion layer was 3.8 mil (96.5 μm) over the support and 5.5 mil (140 μm) over the support for the topcoat layer. The samples were each dried at 185° C. for 4 minutes.

The coated and dried photothermographic elements were cut into 1.5 inch by 8 inch strips (3.8 cm×20.3 cm) and exposed using an EG&G sensitometer for 0.001 seconds using a Xenon flash and a 0 to 3 continuous wedge. No wavelength filters were used. The samples were then developed on a round drum thermal processor for 15 seconds at 250° F. (121° C.).

The results, shown below demonstrate that Speed-2 of the sample containing chemical sensitizing compound CS-1 was 0.22 logE faster than the Control.

| Ex. | | Dmin | Dmax | Speed-2 | AC-1 |
|---|---|---|---|---|---|
| 1-1 | Invention | 0.214 | 4.12 | 2.63 | 7.1 |
| 1-2 | Control | 0.229 | 4.08 | 2.41 | 7.5 |

Samples of the two coatings were also exposed using a wedge spectrograph and developed at 250° F. (121° C.) for 15 seconds. The response clearly demonstrated that there was no residual blue sensitivity as one would expect from undecomposed CS-1 dye. It is therefore apparent that the chemical sensitization has occurred from the CS-1 dye fragments resulting from reaction with the PHP.

Example 2

This example demonstrates the use of an infrared spectral sensitizer in chemically sensitized photothermographic emulsions.

Photothermographic Emulsion B

A pre-formed iridium-doped core-shell silver behenate full soap was prepared as described in U.S. Pat. No. 5,434,043 incorporated herein by reference.

The pre-formed soap contained 2.0 wt % of a 0.07 μm diameter iridium-doped core-shell silver iodobromide emulsion (25% core containing 8% iodide, 92% bromide; and 75% all bromide shell containing $1\times10^{-5}$ mol of iridium). A dispersion of this silver behenate full soap was homogenized to 21.9% solids in 2-butanone containing 1.3% Butvar™ B-79 polyvinyl butyral resin.

To 208 g of this full silver soap dispersion, maintained at 22° C. and rapidly stirred at 1000 rpm, was added a solution of 0.02 g of chemical sensitizing compound CS-1 dissolved in 3 g of methanol.

After stirring for 30 minutes 0.20 g of pyridinium hydrobromide perbromide dissolved in 1 mL of methanol was added. After 60 minutes, a solution of 0.10 g of $CaBr_2.xH_2O$ or $CaBr_2.2H_2O$ dissolved in 1.0 mL of methanol was added. Mixing for 30 minutes was followed by addition of a solution of 0.003 g of spectral sensitizing dye SSD-1, 0.128 g of MMBI and 1.42 g of CBBA in 5 g of methanol.

The solution was then cooled to 12.8° C. (55° F.) and 40 g of Butvar™ B-79 was added. Stirring for 60 minutes was followed by addition of a solution of 1.10 g of antifoggant-1 dissolved in 15 mL of 2-butanone. After 15 minutes, 10.45 g of Nonox™ was added. After 15 minutes 0.28 g of THDI was added. Finally, after 15 minutes, 0.85 g of PHZ and 0.36 g of TCPA were added. After 15 minutes, a solution of 0.45 g 4-MPA dissolved in 4 g of methanol was added.

The mixture was then warmed to 22° C.

A second photothermographic emulsion and topcoat were prepared but without incorporating any CS-1 into the photothermographic emulsion layer. This sample (2-2) served as a control.

A topcoat solution was then prepared as in Example 1.

The solutions were dual knife coated and dried as described above.

The samples were exposed using a laser sensitometer incorporating a 810 nm laser diode. After exposure, the film strips were processed by heating at 250° F. (121° C.) for 15 seconds to give an image.

The sensitometric results, shown below, demonstrate that chemical sensitization of the photothermographic emulsion increased Speed-2 by 0.53 log E.

| Example | | Dmin | Dmax |
|---|---|---|---|
| 2-1 | Invention | 0.255 | 4.02 |
| 2-2 | Control | 0.241 | 3.97 |
| Ex. | Speed-2 | Contrast-1 | Contrast-3 |
| 2-1 | 1.936 | 3.83 | 5.04 |
| 2-2 | 1.408 | 3.49 | 4.17 |

Example 3

This example demonstrates the utility of the chemical sensitizing compounds of this invention with a high-contrast co-developer to form a high-contrast photothermographic element.

Two photothermographic emulsions were prepared using photothermographic emulsion B described in Example 2. Again, a second photothermographic emulsion was prepared but without incorporating any CS-1 into the photothermographic emulsion layer. This sample served as a control (3-2).

CN-02 (0.50 g per 100 g of topcoat solution) was added to the topcoat formulation of each solution. The solutions were dual knife coated, dried, imaged, and developed as described in Example 2 above.

The sensitometric results, shown below, demonstrate that chemical sensitization of the photothermographic emulsion increased Speed-2 by 0.45 log E.

| Example | | Dmin | Dmax |
|---|---|---|---|
| 3-1 | Invention | 0.285 | 4.57 |
| 3-2 | Control | 0.253 | 4.88 |
| Ex. | Speed-2 | Contrast-1 | Contrast-3 |
| 3-1 | 2.408 | 20 | 26 |
| 3-2 | 1.95 | 28 | 36 |

Example 4

This example demonstrates the utility of the present invention with a green spectral sensitizing dye, spectral sensitizing dye SSD-2.

Two photothermographic emulsions were prepared using photothermographic emulsion B described in Example 2 above. In these emulsions, 0.20 g of green spectral sensitizing dye SSD-2 replaced the infrared sensitizing dye SSD-1 used in Example 2. Again, the second photothermographic emulsion did not incorporate CS-1 into the photothermographic emulsion layer. This sample served as a control (4-2).

A topcoat solution was then prepared as described in Example 1.

The solutions were dual knife coated, and dried as described in Example 1 above. Samples were prepared as described above and exposed using an EG&G sensitometer with a Xenon flash exposure for 0.001 seconds through a green filter and a 0–4 wedge, and developed as described in Example 1 above.

The sensitometric results, shown below, demonstrate that chemical sensitization of the photothermographic emulsion increased Speed-2 by 0.4 log E.

| Ex. | | Dmin | Dmax | Speed-2 | Contrast-1 |
|---|---|---|---|---|---|
| 4-1 | Invention | 0.076 | 4.2 | 2.79 | 7.2 |
| 4-2 | Control | 0.09 | 3.5 | 2.37 | 5.5 |

Examples 5–24

Samples prepared in Examples 1–4 have very different silver emulsion coating weights than those of Examples 5–24. They also have different amounts of ingredients and were coated onto different supports having different antihalation back-coats. In addition, samples of Examples 1–4 were imaged on different laser sensitometers, having different spot size, scan line overlap, and laser contact time than samples of Examples 5–24. Also, samples of Examples 1–4 were evaluated on different densitometers using different computerized programs than samples of Examples 5–24. Thus, the results of Examples 1–4 and 5–24 are not directly comparable.

Photothermographic Emulsion C

A pre-formed iridium-doped core-shell silver behenate full soap was prepared as described in U.S. Pat. No. 5,434,043 incorporated herein by reference.

The preformed soap contained 2.0 wt % of a 0.05 $\mu$m diameter iridium-doped core-shell silver iodobromide emulsion (25% core containing 8% iodide, 92% bromide; and 75% all bromide shell containing $1\times^{-5}$ mol of iridium). A dispersion of this silver behenate full soap was homogenized to 21.9% solids in 2-butanone containing 1.3% Butvar™ B-79 polyvinyl butyral resin.

To 186.5 g of this silver full soap dispersion, maintained at 21.1° C. and stirred at 500 rpm, was added a solution of 0.0135 g of chemical sensitizing compound CS-1 dissolved in 2.788 g of methanol.

After mixing for 30 minutes, 1.00 mL of a solution of 0.42 g of pyridinium hydrobromide perbromide dissolved in 2.35 g of methanol was added. After 60 minutes of mixing, 1.00 mL of a solution of 0.632 g of $CaBr_2.2H_2O$ dissolved in 2.35 mL of methanol was added. Mixing for 30 minutes was followed by addition of a solution of spectral sensitizing dye (dyes SSD-01–SSD-08) prepared by mixing the following ingredients.

| Material | Amount |
|---|---|
| CBBA | 2.44 g |
| Spectral Sensitizing Dye | amount indicated |
| MMBI | 0.0907 g |
| 2-MBO | 0.0118 g |
| MeOH | 8.18 g |

After 1 hour of mixing, the temperature was lowered from 21.1° C. to 11.6° C. After 30 minutes at 11.6° C., 34.1 g of Butvar™ B-79 was added. With stirring at 1500 rpm for 30 minutes, the following components were added every 15 minutes.

| Material | Amount |
|---|---|
| Antifoggant-1 | 1.20 g |
| Permanax ™ | 10.02 g |
| THDI | 0.822 g dissolved in |
| MEK | 0.822 g |
| PHZ | 1.00 g dissolved in |

-continued

| Material | Amount |
|---|---|
| MeOH | 1.18 g |
| TCPA | 0.451 g dissolved in |
| MEK | 0.226 g |
| MeOH | 0.226 g |
| 4-MPA | 0.500 g |
| MeOH | 3.03 g |

This photothermographic emulsion was used "as is" to prepare a continuous tone photothermographic element. Continuous tone coatings were prepared by dual knife coating the photothermographic and topcoat formulations at 4.0 mil (101.6 μm) and 5.8 mil (147.3 μm), respectively over the support.

High-contrast coatings were prepared by adding a solution of 0.0072 g of compound CN-08 dissolved in 1.5 g of methanol to a 15 g aliquot of the dye sensitized silver premix as described above.

A topcoat solution was prepared in the following manner; 1.29 g of Acryloid™ A-21 and 33.57 g of CAB 171-15S were mixed until dissolved in 404.7 g 2-butanone and 53.4 g of methanol. To 197.2 g of this premix was then added 0.196 g of vinylsulfone VS-1. The topcoat was diluted by the addition of 42.5 g of 2-butanone.

The photothermographic emulsion layer and topcoat were dual knife coated onto a 4 mil polyester support. The coating gap for the photothermographic emulsion layer was 2.4 mil and 3.5 mil, (over the photothermographic emulsion layer) respectively on a 4 mil PET support containing a removable red antihalation back-coat and dried for 5 minutes at 185° F.

The samples were exposed at either 633 nm or 670 nm using a laser diode sensitometer. The coatings were processed on a heated roll processor for 15 seconds at 250° F. unless otherwise indicated.

Removable Red Antihalation Back-Coat

A removable red antihalation back-coat was prepared in the following manner: To 405 g of water at 180° F. was added 45 g of Vinol™ 523. After the Vinol™ 523 had dissolved, the temperature was lowered to 140° F., 450 g of methanol was added, and mixing continued for 60 minutes. A solution of 18.2 g of polyvinylpyrrolidone dissolved in 72.7 g of methanol was then added and mixed for 2 hours. The temperature was lowered to 70° F., and 9.0 g of Victoria Pure Blue was added and mixed for 1 hour.

The resultant antihalation solution was knife coated on the backside of the photothermographic element using a knife coater. The coating gap for the back-coat was 3 mil. After exposure and processing the antihalation back-coat was removed using a piece of #810 Scotch™ Brand Tape and the sensitometric response was measured.

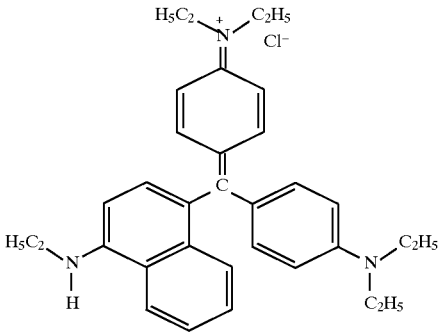

Victoria Pure Blue

For samples exposed using a 633 nm or a 670 nm laser the following definitions are used:

Dmin is the density of the non-exposed areas after development. It is the average of eight lowest density values on the exposed side of the fiducial mark.

Dmax is the highest density value on the exposed side of the fiducial mark.

Speed-1 is Log(1/E)+4 corresponding to the density value at 1.00 above Dmin where E is the exposure in ergs/cm$^2$.

Speed-2 is Log(1/E)+4 corresponding to the density value at 1.00 above Dmin where E is the exposure in ergs/cm$^2$.

Speed-3 is Log(1/E)+4 corresponding to the density value at 3.00 where E is the exposure in ergs/cm$^2$.

Speed-5 is Log(1/E)+4 corresponding to the density value at 3.00 above Dmin where E is the exposure in ergs/cm$^2$.

Contrast A is the absolute value of the slope of the line joining the density points at 0.07 and 0.17 above Dmin.

Contrast C is the absolute value of the slope of the line joining the density points at 0.50 and 2.50 above Dmin.

Contrast D is the absolute value of the slope of the line joining the density points at 1.00 and 3.00 above Dmin.

Example 5

Samples of photothermographic emulsion C were prepared incorporating chemical sensitizing compound CS-1 at three levels 0.0090 g (−), 0.0135 g (0), and 0.018 g (+). A sample was also prepared without any CS-1. This sample served as a control. The photothermographic emulsions were sensitized with $2\times10^{-5}$ mol of red spectral sensitizing dye SSD-3.

The photothermographic emulsion layer and topcoat layer were dual knife coated, dried, exposed using a 633 nm laser, developed, and evaluated as described above.

Samples 5-1 to 5-4 were continuous tone photothermographic elements. Samples 5-6 to 5-8 contained 0.0072 g of compound CN-08 and were high-contrast photothermographic elements. Samples 5-1 and 5-5 contained no CS-1 and served as controls.

The sensitometric results, shown below, demonstrate that chemical sensitization of a photothermographic silver halide emulsion results in an increase in speed of the resulting photothermographic element. This occurs in both continuous tone and high-contrast emulsions.

In the high-contrast elements, an increase in Speed-2 of 0.1 logE at the lower (−) concentration, of 0.2 logE at the normal (0) concentration, and of 0.4 logE at the higher (+) concentration was observed.

In the continuous tone elements, an increase in Speed-2 of 0.06 logE at the lower (−) concentration, of 0.2 logE at the normal (0) concentration, and of 0.56 logE at the (+) higher concentration was observed. Loss of contrast and increase in Dmin were observed in the high-contrast photothermographic elements incorporating CS-1 at the higher (+) concentration.

| Ex. | Level of CS-1 | Dmin | Dmax |
|---|---|---|---|
| 5-1 | none | 0.096 | 4.574 |
| 5-2 | (−) | 0.083 | 4.259 |
| 5-3 | (0) | 0.093 | 4.395 |
| 5-4 | (+) | 0.156 | 4.507 |
| 5-5 | none | 0.049 | 3.952 |
| 5-6 | (−) | 0.052 | 4.471 |
| 5-7 | (0) | 0.051 | 4.124 |
| 5-8 | (+) | 0.062 | 3.326 |

| Ex. | Speed-2 | Speed-5 | Contrast-A | Contrast-D |
|---|---|---|---|---|
| 5-1 | 1.898 | 1.53 | 0.68 | 5.53 |

-continued

| Ex. | Level of CS-1 | | Dmin | Dmax |
|---|---|---|---|---|
| 5-2 | 1.95 | 1.545 | 0.514 | 4.495 |
| 5-3 | 2.087 | 1.659 | 0.474 | 4.675 |
| 5-4 | 2.46 | 1.923 | 0.531 | 3.746 |
| 5-5 | 2.011 | 1.91 | 1.821 | 19.812 |
| 5-6 | 2.106 | 2.051 | 2.07 | 22.197 |
| 5-7 | 2.19 | 2.067 | 1.168 | 17.527 |
| 5-8 | 2.41 | 2.18 | 0.607 | 9.39 |

Example 6

The effect of replacing $CaBr_2.2H_2O$ with an equimolar amount of $InBr_3$ on the speed of the resulting photothermographic element was studied.

Samples of photothermographic emulsion C were prepared with and without chemical sensitizing compound CS-1. Additionally, $CaBr_2$ was replaced with $InBr_3$ at 0.28 or 1.57 molar equivalent to the $CaBr_2$. The photothermographic emulsion was sensitized with $2\times10^{-5}$ mol of red spectral sensitizing dye SSD-3.

Samples 6-1 to 6-6 were continuous tone photothermographic elements. Samples 6-7 to 6-12 contained 0.0072 g of compound CN-08 and were high-contrast photothermographic elements.

The photothermographic emulsion layer and topcoat layer were dual knife coated, dried, exposed using a 633 nm laser, developed, and evaluated as described above.

The results are shown below. In a continuous tone photothermographic element, chemical sensitization resulted in an increase in Speed-2 of 0.25 logE using 1.00 mol equivalent of $CaBr_2$, an increase in speed of 0.1 logE using 0.78 mol equivalent of $InBr_3$ and an increase in speed of 0.32 logE using 1.57 mol equivalent of $InBr_3$. In a high-contrast photothermographic element, chemical sensitization resulted in an increase in Speed-2 of 0.2 logE using 1.00 mol equivalent of $CaBr_2$, an increase in Speed-2 of 0.1 logE using 0.78 mol equivalent of $InBr_3$, and an increase in Speed-2 of 0.2 logE using 1.57 mol equivalent of $InBr_3$.

| Ex. | CS Added | Metal Bromide | Dmin | Dmax |
|---|---|---|---|---|
| 6-1 | none | $CaBr2 \cdot 2H_2O$ | 0.101 | 4.077 |
| 6-2 | CS-1 | $CaBr2 \cdot 2H_2O$ | 0.127 | 3.905 |
| 6-3 | none | 0.78 equiv. $InBr_3$ | 0.092 | 3.898 |
| 6-4 | CS-1 | 0.78 equiv. $InBr_3$ | 0.1 | 3.713 |
| 6-5 | none | 1.57 equiv. $InBr_3$ | 0.103 | 3.636 |
| 6-6 | CS-1 | 1.57 equiv. $InBr_3$ | 0.111 | 4.139 |
| 6-7 | none | $CaBr2 \cdot 2H_2O$ | 0.054 | 3.819 |
| 6-8 | CS-1 | $CaBr2 \cdot 2H_2O$ | 0.061 | 3.881 |
| 6-9 | none | 0.78 equiv. $InBr_3$ | 0.05 | 3.448 |
| 6-10 | CS-1 | 0.78 equiv. $InBr_3$ | 0.062 | 3.714 |
| 6-11 | none | 1.57 equiv. $InBr_3$ | 0.058 | 3.099 |
| 6-12 | CS-1 | 1.57 equiv. $InBr_3$ | 0.058 | 2.731 |

| Ex. | Speed-2 | Speed-5 | Contrast-A | Contrast-D |
|---|---|---|---|---|
| 6-1 | 1.865 | 1.413 | 0.687 | 4.438 |
| 6-2 | 2.113 | 1.548 | 0.469 | 3.571 |
| 6-3 | 1.927 | 1.514 | 0.706 | 4.875 |
| 6-4 | 2.011 | 1.551 | 0.507 | 4.391 |
| 6-5 | 1.663 | 1.17 | 0.717 | 4.196 |
| 6-6 | 1.983 | 1.528 | 0.764 | 4.482 |
| 6-7 | 1.975 | 1.863 | 1.651 | 18.07 |
| 6-8 | 2.165 | 2.054 | 0.721 | 18.118 |
| 6-9 | 1.962 | 1.817 | 1.017 | 13.748 |
| 6-10 | 2.07 | 1.953 | 0.69 | 17.241 |
| 6-11 | 1.783 | — | 0.829 | — |
| 6-12 | 1.956 | — | 1.014 | — |

Example 7

The effect of replacement of $CaBr_2.2H_2O$ with 1.18 molar equivalent of $ZnBr_2$ on the speed of the resulting photothermographic element was studied. The effect of development time on these samples was also studied.

Samples of photothermographic emulsion C were prepared incorporating either $CaBr_2.2H_2O$ or 1.18 molar equivalent of $ZnBr_2$. The photothermographic emulsion was sensitized with $2\times10^{-5}$ mol of red spectral sensitizing dye SSD-3. A sample was also prepared without any CS-1. This sample served as a control.

All samples contained 0.0072 g of compound CN-08 and were high-contrast photothermographic elements. Samples were developed on a heated roll processor for 15 seconds at 250° F. and for 20 seconds at 250° F.

The photothermographic emulsion layer and topcoat layer were dual knife coated, dried, exposed using a 670 nm laser, developed, and evaluated as described above.

The results are shown below. An increase in Speed-1 of 0.17 logE was found with the addition of CS-1 using $CaBr_2.2H_2O$ and 0.30 logE using $ZnBr_2$. When processed for 20 seconds at 250° F. these effects are more pronounced. An increase in Speed-1 of 0.23 logE was found with the addition of CS-1 using $CaBr_2$ and 0.45 logE using $ZnBr_2$.

| Ex. | CS Added | Development Conditions | Metal Bromide | Dmin | Dmax |
|---|---|---|---|---|---|
| 7-1 | none | 15 sec/250° F. | $CaBr_2 \cdot 2H_2O$ | 0.062 | 4.733 |
| 7-2 | CS-1 | 15 sec/250° F. | $CaBr_2 \cdot 2H_2O$ | 0.065 | 4.352 |
| 7-3 | none | 20 sec/250° F. | $CaBr_2 \cdot 2H_2O$ | 0.077 | 4.97 |
| 7-4 | CS-1 | 20 sec/250° F. | $CaBr_2 \cdot 2H_2O$ | 0.089 | 4.753 |
| 7-5 | none | 15 sec/250° F. | $ZnBr_2$ | 0.052 | 4.478 |
| 7-6 | CS-1 | 15 sec/250° F. | $ZnBr_2$ | 0.058 | 4.444 |
| 7-7 | none | 20 sec/250° F. | $ZnBr_2$ | 0.06 | 4.836 |
| 7-8 | CS-1 | 20 sec/250° F. | $ZnBr_2$ | 0.093 | 4.939 |

| Ex. | Speed-1 | Speed-3 | Contrast-A | Contrast-C |
|---|---|---|---|---|
| 7-1 | 1.666 | 1.556 | 1.373 | 17.4 |
| 7-2 | 1.839 | 1.738 | 1.046 | 18.517 |
| 7-3 | 1.876 | 1.8 | 2.85 | 21.117 |
| 7-4 | 2.108 | 2.009 | 1.782 | 20.383 |
| 7-5 | 1.729 | 1.648 | 2.278 | 23.121 |
| 7-6 | 2.031 | 1.929 | 1.429 | 18.665 |
| 7-7 | 1.946 | 1.872 | 4.097 | 21.446 |
| 7-8 | 2.405 | 2.264 | 1.256 | 13.008 |

Example 8

Samples of photothermographic emulsion C were prepared incorporating chemical sensitizing compound CS-1. A sample was also prepared without any CS-1. This sample served as a control. The photothermographic emulsions were sensitized with $2\times10^{-5}$ mol of spectral sensitizing dyes SSD-3, SSD-4, or SSD-5.

The photothermographic emulsion layer and topcoat layer were dual knife coated, dried, exposed using a 670 nm laser, developed, and evaluated as described above.

Samples 8-1 to 8-6 were continuous tone photothermographic elements. Samples 8-7 to 8-18 contained 0.0072 g of compound CN-08 and were high-contrast photothermographic elements.

The sensitometric results, shown below, demonstrate that chemical sensitization of a photothermographic silver halide emulsion results in an increase in speed of the resulting photothermographic element. This occurs in both continuous tone and high-contrast emulsions. In the continuous tone elements, an increase in Speed-1 of 0.14 logE was observed with CS-1 and SSD-3, an increase in Speed-1 of 0.29 logE was observed with CS-1 and SSD-4, and an increase in Speed-1 of 0.23 logE was observed with CDS-1 and SSD-5.

In the high-contrast elements, an increase in Speed-1 of 0.17 logE was observed with CS-1 and SSD-3, an increase in Speed-1 of 0.28 logE was observed with CS-1 and SSD-4, and an increase in Speed-1 of 0.23 logE was observed with CS-1 and SSD-5.

As shown in Examples 8–13 through 8–18, when samples of these high contrast photothermographic elements were developed for 20 seconds at 250° F. (i.e., a longer development time), additional increases in Speed-1 were found. For example, an increase in Speed-1 of 0.23 logE was observed with CS-1 and SSD-3, an increase in Speed-1 of 0.38 logE was observed with CS-1 and SSD-4, and an increase in Speed-1 of 0.33 logE was observed with CS-1 and SSD-5.

| Ex. | CS Added | SSD Used | Dmin | Dmax |
|---|---|---|---|---|
| 8-1 | none | SSD-3 | 0.098 | 3.968 |
| 8-2 | CS-1 | SSD-3 | 0.115 | 3.774 |
| 8-3 | none | SSD-4 | 0.088 | 3.545 |
| 8-4 | CS-1 | SSD-4 | 0.104 | 3.545 |
| 8-5 | none | SSD-5 | 0.076 | 4.129 |
| 8-6 | CS-1 | SSD-5 | 0.083 | 4.112 |
| 8-7 | none | SSD-3 | 0.062 | 4.733 |
| 8-8 | CS-1 | SSD-3 | 0.065 | 4.352 |
| 8-9 | none | SSD-4 | 0.056 | 4.622 |
| 8-10 | CS-1 | SSD-4 | 0.059 | 4.339 |
| 8-11 | none | SSD-5 | 0.045 | 4.537 |
| 8-12 | CS-1 | SSD-5 | 0.052 | 4.488 |
| 8-13 | none | SSD-3 | 0.077 | 4.97 |
| 8-14 | CS-1 | SSD-3 | 0.89 | 4.753 |
| 8-15 | none | SSD-4 | 0.06 | 4.854 |
| 8-16 | CS-1 | SSD-4 | 0.074 | 4.848 |
| 8-16 | none | SSD-5 | 0.05 | 4.788 |
| 8-18 | CS-1 | SSD-5 | 0.057 | 4.81 |
| Ex. | Speed-1 | Speed-3 | Contrast-A | Contrast-C |
| 8-1 | 1.597 | 1.238 | 0.647 | 5.17 |
| 8-2 | 1.738 | 1.332 | 0.542 | 4.774 |
| 8-3 | 1.649 | 1.146 | 0.804 | 4.14 |
| 8-4 | 1.938 | 1.493 | 0.58 | 4.335 |
| 8-5 | 1.393 | 1.114 | 0.823 | 5.994 |
| 8-6 | 1.626 | 1.31 | 0.696 | 5.496 |
| 8-7 | 1.666 | 1.556 | 1.373 | 17.4 |
| 8-8 | 1.839 | 1.738 | 1.046 | 18.517 |
| 8-9 | 1.713 | 1.614 | 1.619 | 19.365 |
| 8-10 | 1.994 | 1.879 | 1.272 | 16.561 |
| 8-11 | 1.584 | 1.514 | 1.338 | 24.673 |
| 8-12 | 1.809 | 1.736 | 0.834 | 23.756 |
| 8-13 | 1.876 | 1.8 | 2.85 | 21.117 |
| 8-14 | 2.108 | 2.009 | 1.782 | 20.383 |
| 8-15 | 1.893 | 1.818 | 2.842 | 21.271 |
| 8-16 | 2.271 | 2.175 | 2.117 | 16.835 |
| 8-17 | 1.742 | 1.672 | 3.471 | 28.317 |
| 8-18 | 2.066 | 2.001 | 2.909 | 26.651 |

Example 9

Samples of photothermographic emulsion C were prepared incorporating chemical sensitizing compound CS-1. A sample was also prepared without any CS-1. This sample served as a control. The photothermographic emulsions were sensitized with $2\times10^{-5}$ mol of spectral sensitizing dye SSD-6.

Continuous tone formulations were prepared incorporating an additional antifoggant in the topcoat solution. PR-01 This compound was added at an amount of 0.045 g per 15 g of topcoat solution for samples 9-1 and 9-2.

High-contrast coatings were prepared by adding a solution of 0.0108 g of compound CN-08 dissolved in 1.5 g of methanol to a 15 g aliquot of the dye sensitized silver premix for samples 9-3 and 9-4.

The photothermographic emulsion layer and topcoat layer were dual knife coated, dried, exposed using a 633 nm laser, developed, and evaluated as described above.

The sensitometric results, shown below, demonstrate that chemical sensitization of a photothermographic silver halide emulsion results in an increase in Speed-2 of the resulting photothermographic element. This occurs in both continuous tone and high-contrast emulsions. In the continuous tone elements, an increase in Speed-2 of 0.13 logE was observed. In a high-contrast element, an increase in Speed-2 of 0.22 logE was observed.

| Ex. | CS Added | Dmin | Dmax |
|---|---|---|---|
| 9-1 | none | 0.099 | 4.332 |
| 9-2 | CS-1 | 0.104 | 4.142 |
| 9-3 | none | 0.055 | 4.65 |
| 9-4 | CS-1 | 0.065 | 4.72 |
| Ex. | Speed-2 | Speed-5 | Contrast-A | Contrast-D |
| 9-1 | 1.932 | 1.588 | 0.573 | 5.812 |
| 9-2 | 2.064 | 1.65 | 0.511 | 4.835 |
| 9-3 | 2.143 | 2.043 | 2.315 | 20.045 |
| 9-4 | 2.364 | 2.235 | 1.547 | 15.573 |

Example 10

Samples of photothermographic emulsion C were prepared incorporating chemical sensitizing compound CS-1. A sample was also prepared without any CS-1. This sample served as a control. The photothermographic emulsions were sensitized with $2\times10^{-5}$ mol of spectral sensitizing dye SSD-7. MBO was not added to the formulation. Samples were prepared with and without the addition of MMBI.

Samples 10-1 to 10-8 were continuous tone photothermographic elements. Samples 10-9 to 10-16 contained 0.0072 g of compound CN-08 and were high-contrast photothermographic elements.

The photothermographic emulsion layer and topcoat layer were dual knife coated, dried, exposed using a 670 nm laser, developed, and evaluated as described above.

The results are shown below. In a continuous tone photothermographic element containing no MMBI, the addition of CS-1 increased Speed-1 by 0.16 logE. With MMBI in the topcoat, the addition of CS-1 increased the Speed-1 by 0.21 logE; however an increase in Dmin was also observed. To improve the Dmin, the antifoggant PR-01 was added at two levels, 0.0225 g (–) and 0.0338 g (+) per 15 g of the topcoat formulation. At (–)PR-01 the addition of CS-1 increased the speed 0.1 logE. The Dmin decreased with the addition of PR-01 into the topcoat. The addition of CS-1 with these coatings was 0.17 logE at (–)PR-01 and 0.15 logE at (+)PR-01.

In a high-contrast photothermographic element containing no MMBI, the addition of CS-1 increased the Speed-1 by 0.1 logE. With MMBI in the photothermographic element, the addition of CS-1 increased Speed-1 by 0.32 logE. The addition of PR-01 at 0.0117 g (–) or 0.0176 g (+) to the high-contrast formulation also improved the Dmin of the CS-1 coatings. With these coatings a Speed-1 increase 0.27 logE at (–)PR-01 and 0.20 logE at (+)PR-01 was observed.

| Ex. | CS-1 Added | MMBI Added | PR-01 Added | Dmin | Dmax |
|---|---|---|---|---|---|
| 10-1 | no | no | no | 0.091 | 4.383 |
| 10-2 | yes | no | no | 0.138 | 4.434 |
| 10-3 | yes | no | yes(–) | 0.105 | 4.3 |
| 10-4 | yes | no | yes(+) | 0.099 | 4.258 |

-continued

| Ex. | CS-1 Added | MMBI Added | PR-01 Added | Dmin | Dmax |
|---|---|---|---|---|---|
| 10-5 | no | yes | no | 0.185 | 4.216 |
| 10-6 | yes | yes | no | 0.254 | 4.306 |
| 10-7 | yes | yes | yes(−) | 0.204 | 4.178 |
| 10-8 | yes | yes | yes(+) | 0.175 | 4.288 |
| 10-9 | no | no | no | 0.049 | 4.947 |
| 10-10 | yes | no | no | 0.059 | 4.81 |
| 10-11 | yes | no | yes(−) | 0.056 | 4.808 |
| 10-12 | yes | no | yes(+) | 0.057 | 4.723 |
| 10-13 | no | yes | no | 0.071 | 4.641 |
| 10-14 | yes | yes | no | 0.104 | 4.646 |
| 10-15 | yes | yes | yes(−) | 0.096 | 4.658 |
| 10-16 | yes | yes | yes(+) | 0.085 | 4.613 |

| Ex. | Speed-1 | Speed-3 | Contrast-A | Contrast-C |
|---|---|---|---|---|
| 10-1 | 1.787 | 1.443 | 0.587 | 4.95 |
| 10-2 | 1.948 | 1.588 | 0.52 | 4.561 |
| 10-3 | 1.882 | 1.545 | 0.507 | 4.42 |
| 10-4 | 1.838 | 1.476 | 0.494 | 4.632 |
| 10-5 | 1.648 | 1.265 | 0.505 | 4.258 |
| 10-6 | 1.862 | 1.511 | 0.451 | 4.061 |
| 10-7 | 1.824 | 1.496 | 0.471 | 4.335 |
| 10-8 | 1.798 | 1.434 | 0.504 | 4.667 |
| 10-9 | 2.015 | 1.94 | 4.02 | 22.126 |
| 10-10 | 2.125 | 2.043 | 1.804 | 23.197 |
| 10-11 | 2.003 | 1.918 | 2.669 | 20.432 |
| 10-12 | 1.898 | 1.822 | 1.685 | 21.519 |
| 10-13 | 1.819 | 1.722 | 1.426 | 18.252 |
| 10-14 | 2.148 | 2.047 | 1.531 | 16.17 |
| 10-15 | 2.085 | 1.974 | 1.263 | 16.821 |
| 10-16 | 2.022 | 1.914 | 1.005 | 17.551 |

Example 11

This example demonstrates the improvement in chemical sensitization by carrying out the chemical sensitization at an elevated temperature.

Samples of photothermographic emulsion C were prepared by carrying out the initial steps in the preparation of the photothermographic emulsion at 23.9° C. and incorporating CS-1. A sample was also prepared without any CS-1. This sample served as a control Additionally, MMBI and MBO were not added;

Additionally, $CaBr_2.2H_2O$ was replaced by 1.18 molar equivalent of $ZnBr_2$.

The photothermographic emulsions were sensitized with $2\times10^{-5}$ mol of spectral sensitizing dye SSD-8.

Samples 11-1 and 11-2 contained 0.0072 g of compound CN-08 and were high-contrast photothermographic elements.

The photothermographic emulsion layer and topcoat layer were dual knife coated, dried, exposed using a 670 nm laser, developed, and evaluated as described above.

The sensitometric results, shown below, demonstrate that chemical sensitization of a high-contrast photothermographic silver halide emulsion at elevated temperature results in an increase in Speed-1 of 0.25 logE in the resulting photothermographic element even when no supersensitizers are added.

| Ex. | CS Added | Dmin | Dmax |
|---|---|---|---|
| 11-1 | none | 0.041 | 5.036 |
| 11-2 | CS-1 | 0.043 | 5.05 |

-continued

| Ex. | CS Added | | Dmin | Dmax |
|---|---|---|---|---|
| Ex. | Speed-1 | Speed-3 | Contrast-A | Contrast-D |
| 11-1 | 2.372 | 2.289 | 2.682 | 24.384 |
| 11-2 | 2.618 | 2.534 | 2.669 | 23.811 |

Example 12

The effects of temperature at which the chemical sensitizing compounds are added on Speed-2 of the resulting photothermographic element was studied as described in Example 11.

Samples of photothermographic emulsion C were prepared incorporating chemical sensitizing compound CS-1 in the photothermographic emulsion at temperatures of 21.1° C. or 22.8° C.

Formulations employing SSD-4 had $2\times10^{-5}$ mol of spectral sensitizing dye and no MBO and no MMBI.

Formulations employing SSD-5 had $3\times10^{-5}$ mol of spectral sensitizing dye and incorporated MBO and MMBI.

Samples 12-1 to 12-6 were continuous tone photothermographic elements. Samples 12-7 to 12-12 contained 0.0072 g of compound CN-08 and were high-contrast photothermographic elements. Samples 12-1, 12-4, 12-7, and 12-10 contained no chemical sensitizing compound and served as controls.

The photothermographic emulsion layer and topcoat layer were dual knife coated, dried, exposed using a 670 nm laser, developed, and evaluated as described above.

The sensitometric results, shown below, demonstrate that the temperature of the emulsion at the time of addition of the chemical sensitizing compound is critical to the chemical sensitization process and to the increase in Speed-2. This occurs in both continuous tone and high-contrast emulsions.

For example, in continuous tone samples, when chemical sensitization was carried out at 21.1° C. using CS-1 as the chemical sensitizing compound and SSD-5 as the spectral sensitizer, an increase in Speed-2 of 0.1 logE was observed; when the same chemical sensitization was carried out at 22.8° C. an increase in Speed-2 of 0.15 logE was observed. When chemical sensitization was carried out at 21.1° C. using CS-1 as the chemical sensitizing compound and SSD-4 as the spectral sensitizer, an increase in Speed-2 of 0.21 logE was observed; when the same chemical sensitization was carried out at 22.8° C., an increase in Speed-2 of 0.31 log E was observed.

In high contrast samples, when chemical sensitization was carried out at 21.1° C. using CS-1 as the chemical sensitizing compound and SSD-5 as the spectral sensitizing dye, an increase in Speed-2 of 0.13 logE was observed; when the same chemical sensitization was carried out at 22.8° C. the Speed-2 increase was 0.16 logE. When chemical sensitization was carried out at 21.1° C. using CS-1 as the chemical sensitizing compound and SSD4 as the spectral sensitizing dye, an increase in Speed-2 of 0.1 logE was observed; when the same chemical sensitization was carried out at 22.8° C., an increase in speed-2 of 0.14 log E was observed.

| Ex. | CS Added | SSD-Added | Temp. | Dmin | Dmax |
|---|---|---|---|---|---|
| 12-1 | none | SSD-4 | 21.1° C. | 0.081 | 3.315 |
| 12-2 | CS-1 | SSD-4 | 21.1° C. | 0.086 | 3.511 |
| 12-3 | CS-1 | SSD-4 | 22.8° C. | 0.093 | 3.425 |
| 12-4 | none | SSD-5 | 21.1° C. | 0.079 | 4.116 |
| 12-5 | CS-1 | SSD-5 | 21.1° C. | 0.079 | 4.111 |
| 12-6 | CS-1 | SSD-5 | 22.8° C. | 0.085 | 4.171 |
| 12-7 | none | SSD-4 | 21.1° C. | 0.049 | 4.857 |
| 12-8 | CS-1 | SSD-4 | 21.1° C. | 0.053 | 4.766 |
| 12-9 | CS-1 | SSD-4 | 22.8° C. | 0.051 | 4.746 |
| 12-10 | none | SSD-5 | 21.1° C. | 0.051 | 4.713 |
| 12-22 | CS-1 | SSD-5 | 21.1° C. | 0.05 | 4.631 |
| 12-12 | CS-1 | SSD-5 | 22.8° C. | 0.053 | 4.514 |

| Ex. | Speed-1 | Speed-3 | Contrast-A | Contrast-C |
|---|---|---|---|---|
| 12-1 | 1.419 | 0.84 | 0.711 | 3.763 |
| 12-2 | 1.63 | 1.086 | 0.814 | 3.918 |
| 12-3 | 1.726 | 1.116 | 0.763 | 3.884 |
| 12-4 | 1.485 | 1.167 | 0.945 | 5.765 |
| 12-5 | 1.573 | 1.228 | 0.708 | 5.161 |
| 12-6 | 1.639 | 1.331 | 0.738 | 5.455 |
| 12-7 | 1.74 | 1.671 | 3.305 | 25.601 |
| 12-8 | 1.843 | 1.773 | 2.12 | 23.851 |
| 12-9 | 1.877 | 1.797 | 2.326 | 20.714 |
| 12-10 | 1.698 | 1.646 | 3.996 | 30.64 |
| 12-11 | 1.825 | 1.771 | 2.375 | 29.452 |
| 12-12 | 1.86 | 1.798 | 2.216 | 25.732 |

Example 13

The effects of both temperature at which the chemical sensitizing compounds are added and replacement of $CaBr_2$ with an equimolar amount of $ZnBr_2$ on the speed of the resulting photothermographic element was studied.

Samples of photothermographic emulsion C were prepared by carrying out the initial steps in the preparation of the photothermographic emulsion at 21.1° C. or at 23.9° C. and incorporating CS-1. A sample was also prepared without any CS-1. This sample served as a control. Additionally, $CaBr_2.2H_2O$ was replaced by 1.18 molar equivalent of $ZrBr_2$. The photothermographic emulsions were sensitized with $2\times10^{-5}$ mol of spectral sensitizing dye SSD-3.

The photothermographic emulsion layer and topcoat layer were dual knife coated, dried, exposed using a 633 nm laser, developed, and evaluated as described above.

Samples 13-1 to 13-3 were continuous tone photothermographic elements. Samples 13-4 to 13-6 contained 0.0072 g of compound CN-08 and were high-contrast photothermographic elements. Samples 13-1 and 134 contained no CS-1 and served as controls.

The sensitometric results, shown below, demonstrate the critical importance of temperature at which chemical sensitization of a photothermographic silver halide emulsion is carried out.

For example, in continuous tone elements, when chemical sensitization was carried out at 21.2° C. using CS-1 as the chemical sensitizing compound and SSD-3 as the spectral sensitizing dye, an increase in Speed-2 of only 0.02 log E was observed; when the same chemical sensitization was carried out at 23.9° C. an increase in Speed-2 of 0.24 logE was observed. In high-contrast photothermographic samples, when chemical sensitization was carried out at 21.2° C. using CS-1 as the chemical sensitizing compound and SSD-3 as the spectral sensitizing dye, an increase in Speed-2 of only 0.02 log E was observed; when the same chemical sensitization was carried out at 23.9° C. an increase in Speed-2 of 0.34 logE was observed.

| Ex. | CS Added | SSD-Added | Temp. | Dmin | Dmax |
|---|---|---|---|---|---|
| 13-1 | none | SSD-3 | 21.1° C. | 0.085 | 4.278 |
| 13-2 | CS-1 | SSD-3 | 21.1° C. | 0.086 | 4.162 |
| 13-3 | CS-1 | SSD-3 | 23.9° C. | 0.111 | 4.066 |
| 13-4 | none | SSD-3 | 21.1° C. | 0.045 | 4.783 |
| 13-5 | CS-1 | SSD-3 | 21.1° C. | 0.053 | 4.797 |
| 13-6 | CS-1 | SSD-3 | 23.9° C. | 0.058 | 4.79 |

| Ex. | Speed-2 | Speed-5 | Contrast-A | Contrast-D |
|---|---|---|---|---|
| 13-1 | 1.912 | 1.588 | 0.746 | 6.18 |
| 13-2 | 1.936 | 1.555 | 0.518 | 5.248 |
| 13-3 | 2.163 | 1.726 | 0.587 | 4.57 |
| 13-4 | 2.126 | 2.052 | 3.143 | 27.037 |
| 13-5 | 2.142 | 2.069 | 2.677 | 27.56 |
| 13-6 | 2.473 | 2.379 | 2.333 | 21.112 |

Example 14

Photothermographic emulsion C was prepared incorporating $2.98\times10^{-5}$ mol of various chemical sensitizing compounds. Samples were also prepared without any chemical sensitizing compounds. These samples served as controls. Additionally, $CaBr_2.2H_2O$ was replaced by 1.18 molar equivalent of $ZnBr_2$. The photothermographic emulsions were sensitized with $2\times10^{-5}$ mol of spectral sensitizing dye SSD-3.

Samples 14-1 to 14-13 were continuous tone photothermographic elements. Samples 14-14 to 14-26 contained 0.0072 g of compound CN-08 and were high-contrast photothermographic elements.

The photothermographic emulsion layer and topcoat layer were dual knife coated, dried, exposed using a 633 nm laser, developed, and evaluated as described above.

The results are shown below. For a continuous tone photothermographic element incorporating CS-7, processing for 15 seconds at 250° F. had little effect on Speed-2, CS-3 increased Speed-2 by only 0.06 logE, CS-4 and CS-5 increased Speed-2 by less than 0.1 logE, and CS-6 increased Speed-2 by 0.18 logE. The speed increase for CS-1 was 0.26 logE.

In high-contrast photothermographic elements, CS-7 had little effect on Speed-2, CS-3 increased Speed-2 only 0.05 logE, CS-4 and CS-5 increased Speed-2 by 0.1 logE, CS-6 increased Speed-2 by 0.25 logE, and CS-1 increased Speed-2 by 0.30 logE.

When the photothermographic elements were developed for 20 seconds at 250° F., Speed-2 increases were higher than those observed for identical samples developed for 15 seconds. For example, when high-contrast photothermographic elements were developed for 20 seconds at 250° F., an additional Speed-2 increase of 0.25 logE was found for CS-1, CS-5, and CS-6, a Speed-2 increase of 0.24 logE was found for. CS-3, a Speed-2 increase of 0.15 logE for CS-4, and a 0.15 logE Speed-2 increase for CS-7.

| Ex. | CS Added | Development Conditions | Dmin | Dmax |
|---|---|---|---|---|
| 14-1 | none | 15 sec/250° F. | 0.08 | 4.466 |
| 14-2 | CS-1 | 15 sec/250° F. | 0.091 | 4.372 |
| 14-3 | CS-5 | 15 sec/250° F. | 0.07 | 4.268 |
| 14-4 | CS-7 | 15 sec/250° F. | 0.075 | 4.258 |
| 14-5 | CS-3 | 15 sec/250° F. | 0.086 | 4.342 |
| 14-6 | CS-4 | 15 sec/250° F. | 0.086 | 4.427 |
| 14-7 | CS-6 | 15 sec/250° F. | 0.094 | 4.33 |

-continued

| Ex. | CS Added | Development Conditions | Dmin | Dmax |
|---|---|---|---|---|
| 14-8 | CS-1 | 20 sec/250° F. | 0.127 | 4.172 |
| 14-9 | CS-5 | 20 sec/250° F. | 0.101 | 4.238 |
| 14-10 | CS-7 | 20 sec/250° F. | 0.092 | 4.278 |
| 14-11 | CS-3 | 20 sec/250° F. | 0.093 | 4.233 |
| 14-12 | CS-4 | 20 sec/250° F. | 0.12 | 4.309 |
| 14-13 | CS-6 | 20 sec/250° F. | 0.139 | 4.214 |
| 14-14 | none | 15 sec/250° F. | 0.042 | 4.323 |
| 14-15 | CS-1 | 15 sec/250° F. | 0.047 | 4.211 |
| 14-16 | CS-5 | 15 sec/250° F. | 0.046 | 4.277 |
| 14-17 | CS-7 | 15 sec/250° F. | 0.045 | 4.177 |
| 14-18 | CS-3 | 15 sec/250° F. | 0.043 | 4.291 |
| 14-19 | CS-4 | 15 sec/250° F. | 0.046 | 4.314 |
| 14-20 | CS-6 | 15 sec/250° F. | 0.049 | 4.216 |
| 14-21 | CS-1 | 20 sec/250° F. | 0.059 | 4.558 |
| 14-22 | CS-5 | 20 sec/250° F. | 0.054 | 4.719 |
| 14-23 | CS-7 | 20 sec/250° F. | 0.051 | 4.605 |
| 14-24 | CS-3 | 20 sec/250° F. | 0.051 | 4.612 |
| 14-25 | CS-4 | 20 sec/250° F. | 0.056 | 4.535 |
| 14-26 | CS-6 | 20 sec/250° F. | 0.064 | 4.533 |

| Ex. | Speed-2 | Speed-5 | Contrast-A | Contrast-C |
|---|---|---|---|---|
| 14-1 | 1.843 | 1.53 | 0.763 | 6.444 |
| 14-2 | 2.096 | 1.639 | 0.595 | 4.442 |
| 14-3 | 1.928 | 1.538 | 0.554 | 5.17 |
| 14-4 | 1.819 | 1.457 | 0.685 | 5.617 |
| 14-5 | 1.9 | 1.564 | 0.642 | 5.994 |
| 14-6 | 1.924 | 1.561 | 0.587 | 5.514 |
| 14-7 | 2.019 | 1.593 | 0.577 | 4.726 |
| 14-8 | 2.211 | 1.63 | 0.469 | 3.44 |
| 14-9 | 2.01 | 1.47 | 0.546 | 3.8 |
| 14-10 | 1.928 | 1.453 | 0.772 | 4.257 |
| 14-11 | 1.962 | 1.378 | 0.529 | 3.485 |
| 14-12 | 2. | 1.491 | 0.623 | 3.929 |
| 14-13 | 2.147 | 1.602 | 0.502 | 3.688 |
| 14-14 | 1.972 | 1.885 | 2.345 | 23.075 |
| 14-15 | 2.265 | 2.158 | 1.413 | 18.781 |
| 14-16 | 2.07 | 1.979 | 1.742 | 22.177 |
| 14-17 | 1.99 | 1.905 | 2.339 | 23.585 |
| 14-18 | 2.019 | 1.929 | 1.755 | 22.351 |
| 14-19 | 2.076 | 1.99 | 2.168 | 23.427 |
| 14-20 | 2.22 | 2.122 | 1.748 | 20.652 |
| 14-21 | 2.522 | 2.396 | 2.512 | 16.488 |
| 14-22 | 2.313 | 2.226 | 2.594 | 23.13 |
| 14-23 | 2.151 | 2.082 | 3.124 | 29.029 |
| 14-34 | 2.26 | 2.18 | 3.282 | 25.178 |
| 14-25 | 2.246 | 2.156 | 2.545 | 22.577 |
| 14-26 | 2.488 | 2.39 | 2.284 | 20.336 |

Example 15

Photothermographic emulsion C was prepared at 23.9° C. incorporating $2.98\times10^{-5}$ mol of CS-2 or CS-6. A sample containing no chemical sensitizing compound was also prepared. It served as a control.

Additionally, MMBI and MBO were not added.

Additionally, $CaBr_2.2H_2O$ was replaced by 1.18 molar equivalent of $ZnBr_2$.

All Samples contained 0.0072 g of compound CN-08 and were high-contrast photothermographic elements.

The photothermographic emulsion was sensitized by addition of $2\times10^{-5}$ mol of spectral sensitizing dye SSD-8.

The photothermographic emulsion layer and topcoat layer were dual knife coated, dried, exposed using a 670 nm laser, developed, and evaluated as described above.

The sensitometric results, shown below, demonstrate an increase in Speed-1 of 0.26 logE with the addition of CS-2 and an increase in speed of 0.30 logE with the addition of CS-6 in high-contrast formulations.

| Ex. | CS Added | Dmin | Dmax |
|---|---|---|---|
| 15-1 | none | 0.036 | 4.615 |
| 15-2 | CS-2 | 0.04 | 4.733 |
| 15-3 | CS-6 | 0.049 | 4.811 |

| Ex. | Speed-1 | Speed-3 | Contrast-A | Contrast-D |
|---|---|---|---|---|
| 15-1 | 2.155 | 2.048 | 1.532 | 18.681 |
| 15-2 | 2.423 | 2.301 | 1.811 | 16.384 |
| 15-3 | 2.461 | 2.339 | 1.886 | 16.485 |

Example 16

Photothermographic emulsion C was prepared at 23.9° C. incorporating $2.98\times10^{-5}$ mol of chemical sensitizing compounds CS-1, or CS-8. A sample containing no chemical sensitizing compound was also prepared. This sample served as a control. A sample containing a dye that is not a chemical sensitizing compound, non-CS-A, was also evaluated.

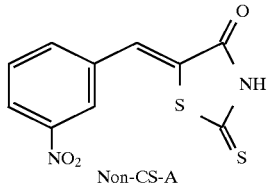

Non-CS-A

Additionally, MMBI and MBO were not added.

Additionally, $CaBr_2.2H_2O$ was replaced by 1.18 molar equivalent of $ZnBr_2$.

The photothermographic emulsion was sensitized by addition of $2\times10^{-5}$ mol of spectral sensitizing dye SSD-8.

Samples 16-1 to 16-4 were continuous tone photothermographic elements. Samples 16-5 to 16-8 contained 0.0072 g of compound CN-08 and were high-contrast photothermographic elements. Samples 16-1 and 16-5 contained no CS-1 and served as controls.

The photothermographic emulsion layer and topcoat layer were dual knife coated, dried, exposed using a 670 nm laser, developed, and evaluated as described above.

The results are shown below. In a continuous tone photothermographic element, chemical sensitization resulted in an increase in Speed-2 of 0.32 logE using CS-1 (with some increase in Dmin), an increase in Speed-2 of 0.12 logE with CS-8 (and no increase in Dmin), and a decrease in Speed-2 of 0.34 logE using non-CS-A. In a high-contrast photothermographic element, chemical sensitization resulted in an increase in Speed-2 of 0.25 logE using CS-1, an increase in speed of 0.04 logE with CS-8, and a decrease in speed of 0.25 logE using non-CS-A.

| Ex. | CS Added | Dmin | Dmax |
|---|---|---|---|
| 16-1 | none | 0.086 | 3.888 |
| 16-2 | CS-1 | 0.132 | 3.958 |
| 16-3 | CS-8 | 0.085 | 3.924 |
| 16-4 | non-CS-A | 0.094 | 3.515 |
| 16-5 | none | 0.041 | 5.036 |
| 16-6 | CS-1 | 0.043 | 5.05 |
| 16-7 | CS-8 | 0.042 | 4.963 |
| 16-8 | non-CS-A | 0.04 | 4.99 |

-continued

| Ex. | | CS Added | Dmin | Dmax |
|---|---|---|---|---|
| Ex. | Speed-1 | Speed-3 | Contrast-A | Contrast-D |
| 16-1 | 1.968 | 1.452 | 0.481 | 3.882 |
| 16-2 | 2.28 | 1.612 | 0.526 | 2.996 |
| 16-3 | 2.09 | 1.467 | 0.544 | 3.213 |
| 16-4 | 1.635 | 0.998 | 0.395 | 3.144 |
| 16-5 | 2.372 | 2.289 | 2.628 | 24.384 |
| 16-6 | 2.618 | 2.534 | 2.669 | 23.811 |
| 16-7 | 2.411 | 2.332 | 2.744 | 25.525 |
| 16-8 | 2.112 | 2.009 | 1.76 | 19.457 |

Example 17

The effect chemical sensitization and silver halide grain size used in the photothermographic emulsion was studied. A large grain photothermographic emulsion containing 0.12 μm size grains was compared with the small grain emulsion used in photothermographic emulsion C. Both formulations were prepared incorporating $2\times10^{-5}$ mol of spectral sensitizing dye SSD-3 in the photothermographic emulsion.

Samples 17-1 and 17-2 incorporated a small grain photothermographic emulsion. Samples 17-3 and 17-4 incorporated a large grain photothermographic emulsion.

All of these samples contained 0.0072 g of compound CN-08 and were high-contrast photothermographic elements.

The photothermographic emulsion layer and topcoat layer were dual knife coated, dried, exposed using a 633 nm laser, developed, and evaluated as described above.

The sensitometric results are shown below. The samples prepared using CS-1 in small silver halide grain emulsions showed a Speed-2 increase of 0.04 logE upon chemical sensitization. The photothermographic emulsion prepared using CS-1 in large silver halide grains showed a Speed-2 increase of 0.08 logE above that using the small silver halide grain emulsion. Additionally, the photothermographic emulsion using the large size silver halide grains showed a further speed increase of 0.80 logE upon chemical sensitization. It should be noted that photothermographic elements prepared from the large grain photothermographic emulsion had slightly higher Dmin (+0.01) and lower contrast (15.9) than those prepared from the small grain emulsion.

| Ex. | | CS Added | Dmin | Dmax |
|---|---|---|---|---|
| 17-1 | | none | 0.056 | 4.908 |
| 17-2 | | CS-1 | 0.056 | 4.743 |
| 17-3 | | none | 0.064 | 4.823 |
| 17-4 | | CS-1 | 0.096 | 4.515 |
| Ex. | Speed-2 | Speed-5 | Contrast-A | Contrast-D |
| 17-1 | 2.166 | 2.092 | 2.812 | 26.975 |
| 17-2 | 2.204 | 2.112 | 2.268 | 21.839 |
| 17-3 | 2.247 | 2.12 | 2.214 | 15.886 |
| 17-4 | 3.043 | 2.864 | 1.271 | 11.203 |

Examples 18–24

Examples 18–24 demonstrate the criticality of the order of addition of the chemical sensitizing compound, the oxidizing agent, and the spectral sensitizing dye.

Photothermographic emulsion C was prepared incorporating $2\times10^{-5}$ mol of spectral sensitizing dye SSD-3 in the photothermographic emulsion. As described above, the initial steps of the preparation of the photothermographic emulsion were carried out at 23.9° C.; the final steps were carried out at 11.6° C.

MBO was not added to the formulation.

Additionally, $CaBr_2.2H_2O$ was replaced by 1.18 molar equivalent of $ZnBr_2$.

Examples 18–24 contained 0.0072 g of compound CN-08 and were high-contrast photothermographic elements.

The order of addition of the relevant materials is shown below.

Example 18

Control

PHP
$ZnBr_2$
SSD-3/MMBI spectral sensitizing dye solution
Antifoggant-1
This sample had no chemical sensitizing compound

Example 19

Invention

Chemical sensitizing compound CS-1
PHP
$ZnBr_2$
SSD-3/MMBI spectral sensitizing dye solution
Antifoggant-1

Example 20

PHP
$ZnBr_2$
Chemical sensitizing compound CS-1
SSD-3 MMBI spectral sensitizing dye solution
Antifoggant-1
In this sample, the chemical sensitizing compound was added after the PHP and before the spectral sensitizing dye solution.

Example 21

PEP
$ZnBr_2$
SSD-3 MMBI spectral sensitizing dye solution
Chemical sensitizing compound CS-1
Antifoggant-1
In this sample, the chemical sensitizing compound was added after the PHP and after the spectral sensitizing dye solution.

Example 22

SSD-3/MMBI spectral sensitizing dye solution
PHP
$ZnBr_2$
Chemical sensitizing compound CS-1
Antifoggant-1
In this sample, the spectral sensitizing dye solution was added before the PHP and the chemical sensitizing compound was added after the PHP.

Example 23

PHP
$ZnBr_2$

Chemical sensitizing compound CS-1

Antifoggant-1

In this sample the chemical sensitizing compound was added after the PHP and no spectral sensitizing dye solution was added.

Example 24

Chemical sensitizing compound CS-1

$ZnBr_2$

SSD-3/MMBI spectral sensitizing dye solution

Antifoggant-1

In this sample no PHP was added.

For all samples, the photothermographic emulsion layer and topcoat layer were dual knife coated, dried, exposed using a 633 nm laser, developed, and evaluated as described above.

The results, shown below, demonstrate that the chemical sensitizing compound must be added before the oxidizing agent to produce photothermographic materials with high speed and low fog.

In Example 19, where the CS-1 was added before the PEP, a Speed-2 increase of 0.53 log E was found when compared with Example 18, the control sample containing no CS-1. There is a small increase of 0.04 in Dmin and some loss in contrast. As in the examples above, this small increase in Dmin and loss in contrast can be reduced by decreasing the amount of chemical sensitizing compound added or reducing the initial temperature during this addition.

In Example 20, where the CS-1 was added after the PHP, there was virtually no effect on the sensitometric response such as the speed increase observed in Example 19. The sensitometry of Example 20 was very similar to Example 18.

In Example 21, where the CS-1 was added after the spectral sensitizing dye, there was virtually no effect on the sensitometric response such as the speed increase observed in Example 19. The sensitometry of Example 21 was very similar to Example 18.

In Example 22 where the chemical sensitizing compound was added before the PHP, the samples fogged.

In Example 23, where the chemical sensitizing compound was added after the PHP, but without a spectral sensitizing dye no image was obtained.

In Example 24, where the chemical sensitizing compound was added but PHP was not added, the samples fogged.

| Ex. | Dmin | Dmax |
|---|---|---|
| 18 | 0.05 | 4.576 |
| 19 | 0.092 | 4.107 |
| 20 | 0.042 | 4.383 |
| 21 | 0.046 | 4.408 |
| 22 | Fogged | — |
| 23 | No Image | — |
| 24 | Fogged | — |

| Ex. | Speed-2 | Speed-5 | Contrast-1 | Contrast-3 |
|---|---|---|---|---|
| 18 | 2.066 | 1.971 | 1.28 | 21.114 |
| 19 | 2.595 | 2.426 | 0.973 | 12.086 |
| 20 | 2.043 | 1.939 | 1.985 | 19.406 |
| 21 | 2.049 | 1.95 | 1.611 | 20.448 |
| 22 | — | — | — | — |
| 23 | — | — | — | — |
| 24 | — | — | — | — |

Examples 25–30

Examples 25–30 demonstrate the criticality of the place in the preparation of the photothermographic emulsion where the chemical sensitizing compound must be added. Examples 25–30 also demonstrate the use of 2-thio-3-phenethyl-4-oxo-oxazolidine described in U.S. Pat. No. 4,207,108 (Hiller) in a photothermographic element. This compound was prepared by the general procedure of Tsukamoto, S. et. al. *J. Med Chem.* 1993, 36, 2292–2299. It has the structure shown below.

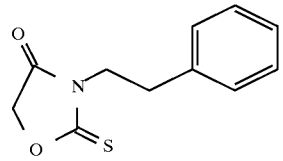

Photothermographic Emulsion D

A pre-formed iridium-doped core-shell silver behenate full soap was prepared as described in U.S. Pat. No. 5,434,043 incorporated herein by reference.

The pre-formed soap contained 2.0 wt % of a 0.05 $\mu$m diameter iridium-doped core-shell silver iodobromide emulsion (25% core containing 8% iodide, 92% bromide; and 75% all bromide shell containing $1\times^{-5}$ mol of iridium). A dispersion of this silver behenate full soap was homogenized to 26.5% solids in 2-butanone containing 1.3% Butvar™ B-79.

To 172 g of this silver full soap dispersion, maintained at 76° F. (24.4° C.) and stirred at 400 rpm, was added 23 g of 2-butanone. For Examples 27 and 28, stirring for 10 minutes was followed by addition of a suspension or solution of the chemical sensitizing compound in 3.00 g of methanol. After mixing for 30 minutes, a solution of 0.23 g of pyridinium hydrobromide perbromide dissolved in 1.5 g of methanol was added. After 30 minutes of mixing, a solution of 0.17 g of $CaBr_2.2H_2O$ dissolved in 1.5 mL of methanol was added. For Example 29, stirring for 5 minutes was followed by addition of a suspension or solution of the chemical sensitizing compound in 3.00 g of methanol. Mixing for 30 minutes was followed by addition of a solution of spectral sensitizing dye SSD-1 prepared by mixing the following ingredients.

| Material | Amount |
|---|---|
| MMBI | 0.098 g |
| CBBA | 1.59 g |
| SSD-1 | 0.0448 |
| MeOH | 72.1 g |
| 2-Butanone | 22.4 g |

After 60 minutes of mixing, the temperature was lowered from 24.4° C. to 10.0° C. and 0.96 g of a 25% solution of Vitel™ PE-2200 in 2-butanone was added. Mixing for 30 minutes was followed by addition of 45.8 g of Butvar™ B-79. After stirring at 850 rpm for 30 minutes, the following components were then added every 15 minutes.

| Material | Amount |
|---|---|
| Antifoggant-1 | 1.23 g dissolved in |
| MEK | 15 g |
| Permanax ™ | 10.6 g |
| THDI | 0.63 g dissolved in |
| MEK | 1.5 g |
| TCPA | 0.35 g dissolved in |
| MEK | 1.0 g |

-continued

| Material | Amount |
|---|---|
| PHZ | 1.05 g dissolved in |
| MeOH | 6.00 g |
| 4-MPA | 0.47 g dissolved in |
| MEK | 3.5 g and |
| MeOH | 0.5 g |

In Examples 30, stirring for 15 minutes was followed by addition of a suspension or solution of chemical sensitizing in 3.00 g of methanol as described below.

This photothermographic emulsion was used "as is" to prepare a continuous tone photothermographic element.

A topcoat solution was prepared in the following manner; 13.95 g of CAB 171-15S was dissolved in 551 g of 2-butanone. To this was added 1.86 g of Acryloid™ A-21. To this premix was then added 0.86 g of vinylsulfone VS-1 (71% solids in ethanol), 0.51 g of antihalation dye AH-2 and the indicated amount of PR-01 or PR-08 if used.

The photothermographic emulsion layer and topcoat were dual knife coated onto a 7 mil (176 μm) blue tinted polyethylene terephthalate support provided with an antihalation back-coating containing AH Dye-2 in CAB 381-20 resin. The coating gap for the photothermographic emulsion layer was 3.8 mil (96.5 μm) over the support and the coating gap for the topcoat layer was 5.2 mil (132 μm) over the support. The samples were each dried at 185° C. for 4 minutes.

Example 25 contained no chemical sensitizing compound. It served as a control.

Example 26 contained 0.020 g of CS-1 (1×level).

Example 27 contained 0.013 g of 2-thio-3-phenethyl-4-oxo-oxazolidine (1×level).

Example 28 contained 0.026 g of 2-thio-3-phenethyl-4-oxo-oxazolidine (2×level).

Example 29 contained 0.013 g of 2-thio-3-phenethyl-4-oxo-oxazolidine (1×level) added after the $CaBr_2$.

Example 30 contained 0.013 g of 2-thio-3-phenethyl-4-oxo-oxazolidine (1×level) added at the end of the preparation of the photothermographic emulsion.

Samples 25-2, 26-2, 27-2, 28-2, 29-2, and 30-2 contained 0.31 g of PR-01.

Samples 25-3, 26-3, 27-3, 28-3, 29-3, and 30-3 contained 0.12 g of PR-08.

Samples were stored in the dark for 5 days under ambient conditions. They were then cut into 1.5 inch by 8 inch strips (3.8 cm×20.3 cm) and exposed using a laser sensitometer incorporating a 810 nm laser diode as described in Example 2 above. After exposure, the film strips were developed on a round drum thermal processor for 15 seconds at 255° F. (123.9° F.). Sensitometry was determined as described in Examples 14 above.

The results, shown below, demonstrate that the chemical sensitizing compound must be added before the oxidizing agent to achieve chemical sensitization and to produce photothermographic materials with high speed and low fog. In general, the samples where the chemical sensitizing compound was added before the oxidizing agent have higher Dmax, Speed-2, Speed-3, and Contrast-3 than the samples in which the chemical sensitizing compound was added either after the addition of the $CaBr_2$ or at the end of the preparation of the photothermographic emulsion. The samples in which the chemical sensitizing compound was added after the $CaBr_2$ had high levels of fog (i.e., high Dmin). The samples in which the chemical sensitizing compound was added at the end of the preparation of the photothermographic emulsion have similar sensitometry to the control sample which contained no chemical sensitizing compound.

It should also be noted that 2-thio-3-phenethyl-4-oxooxazolidine provides less chemical sensitization of photothermographic emulsions than CS-1, even when used at twice the amount.

| Ex. | PR Compound Added | Dmin | Dmax |
|---|---|---|---|
| 25-1 | none | 0.228 | 3.85 |
| 25-2 | PR-01 | 0.204 | 3.74 |
| 25-3 | PR-08 | 0.204 | 3.67 |
| 26-1 | none | 0.219 | 4.37 |
| 26-2 | PR-01 | 0.190 | 4.33 |
| 26-3 | PR-08 | 0.190 | 4.17 |
| 27-1 | none | 0.191 | 3.63 |
| 27-2 | PR-01 | 0.183 | 3.72 |
| 27-3 | PR-08 | 0.181 | 3.52 |
| 28-1 | none | 0.195 | 3.69 |
| 28-2 | PR-01 | 0.188 | 3.85 |
| 28-3 | PR-08 | 0.186 | 3.74 |
| 29-1 | none | 1.04 | 4.38 |
| 29-2 | PR-01 | 0.630 | 4.24 |
| 29-3 | PR-08 | 0.581 | 4.04 |
| 30-1 | none | 0.209 | 3.55 |
| 30-2 | PR-01 | 0.188 | 3.57 |
| 30-3 | PR-08 | 0.188 | 3.61 |

| Ex. | Speed-2 | Speed-3 | Contrast-1 | Contrast-3 |
|---|---|---|---|---|
| 25-1 | 1.59 | 1.11 | 4.08 | 2.99 |
| 25-2 | 1.50 | 1.07 | 4.13 | 3.98 |
| 25-3 | 1.48 | 0.99 | 3.63 | 3.72 |
| 26-1 | 1.98 | 1.55 | 4.11 | 3.69 |
| 26-2 | 1.92 | 1.54 | 4.46 | 4.71 |
| 26-3 | 1.87 | 1.46 | 3.94 | 5.04 |
| 27-1 | 1.58 | 1.07 | 4.00 | 2.70 |
| 27-2 | 1.50 | 1.08 | 4.12 | 4.27 |
| 27-3 | 1.48 | 0.98 | 3.58 | 3.58 |
| 28-1 | 1.68 | 1.19 | 4.03 | 2.75 |
| 28-2 | 1.64 | 1.22 | 4.39 | 3.63 |
| 28-3 | 1.59 | 1.12 | 3.77 | 3.85 |
| 29-1 | 2.23 | 1.26 | 3.27 | 1.12 |
| 29-2 | 2.12 | 1.59 | 3.49 | 2.87 |
| 29-3 | 2.02 | 1.38 | 2.90 | 2.72 |
| 30-1 | 1.52 | 1.03 | 3.88 | 3.07 |
| 30-2 | 1.44 | 0.98 | 4.28 | 3.26 |
| 30-3 | 1.44 | 0.96 | 3.77 | 3.64 |

Examples 31–34

Examples 31–34 further demonstrate the criticality of the place in the preparation of the photothermographic emulsion where the chemical sensitizing compound must be added. They also demonstrate the use of N-ethyl-rhodanine described in U.S. Pat. No. 4,207,108 (Hiller) in a photothermographic element.

Photothermographic Emulsion E

The following procedure was carried out under red light. A pre-formed iridium-doped core-shell silver behenate full soap was prepared as described in U.S. Pat. No. 5,434,043 incorporated herein by reference.

The pre-formed soap contained 2.0 wt % of a 0.05 μm diameter iridium-doped core-shell silver iodobromide emulsion (25% core containing 8% iodide, 92% bromide; and 75% all bromide shell containing $1\times10^{-5}$ mol of iridium). A dispersion of this silver behenate full soap was homogenized to 22.3% solids in 2-butanone containing 1.1% Butvar™.

To 257.87 g of this silver full soap dispersion, maintained at 67° F. (19.4° C.) and stirred at 400 rpm, was added 11.19 g of 2-butanone. In Examples 31 and 32, stirring for 30 minutes was followed by addition of a suspension or solution of chemical sensitizing compound as described below.

After mixing for 30 minutes, a solution of 0.286 g of pyridinium hydrobromide perbromide dissolved in 1.62 g of methanol was added. After 60 minutes of mixing, a solution of 0.218 g of $CaBr_2$¢$2H_2O$ dissolved in 1.24 g of methanol was added. The red safelights were changed to infrared safelights; mixing for 30 minutes was followed by addition of a solution of spectral sensitizing dye prepared by mixing the following ingredients.

| Material | Amount |
|---|---|
| SSD-1 | 0.0040 g |
| MMBI | 0.181 g |
| CBBA | 2.01 g |
| MeOH | 10.44 g |
| 2-Butanone | 2.61 g |

After 60 minutes of mixing, the temperature was lowered to 50° F. (10° C.). After 30 minutes, 65.55 g of Butvar™ B-79 was added. While stirring at 1000 rpm for 30 minutes, the following components were added every 15 minutes.

| Material | Amount |
|---|---|
| Antifoggant-1 | 1.55 g dissolved in |
| MEK | 17.88 g |
| Permanax ™ | 13.45 g |
| THDI | 0.79 g dissolved in |
| MEK | 0.79 g |
| TCPA | 0.444 g dissolved in |
| MEK | 1.26 g |
| PHZ | 1.333 g dissolved in |
| MeOH | 4.73 g |
| 4-MPA | 0.666 g dissolved in |
| MEK | 3.87 g |

In Examples 34 and 35, stirring for 15 minutes was followed by addition of a suspension or solution of chemical sensitizing compound as described below.

Each of these photothermographic emulsions was used "as is" to prepare a continuous tone photothermographic element.

A topcoat solution was prepared in the following manner; 45.52 g of CAB 171-15S was dissolved in 255.13 g of 2-butanone. To this was added a solution of 1.15 g of $CaCO_3$ in 1.55 g of CAB 171-15S and 8.77 g of 2-butanone. 281.94 g of MEK was added, followed by 1.81 g of Acryloid™ A-21. To this premix was then added 0.79 g of VS-1, a vinylsulfone (79% solids in ethanol), 0.31 g of BZT, and 0.072 g of antihalation dye AH-2.

Each of the photothermographic emulsions and a 20 g aliquot of topcoat formulations were dual knife coated onto a 7 mil (176 $\mu$m) blue tinted polyethylene terephthalate support. The coating gap for the photothermographic emulsion layer was 3.7 mil (94.0 $\mu$m) over the support. The coating gap for the topcoat layer was 4.9 mil (124.5 $\mu$m) over the support. The samples were each dried at 175° C. for 4 minutes. All samples were continuous tone photothermographic elements.

Example 31 contained no chemical sensitizing compound; it serves as a control.

Example 32 contained 0.0195 g of CS-1 in 11.19 g of MEK/MeOH (50:50 wt %); it was added before the PHP oxidizing agent.

Example 33 contained 0.0069 g of N-ethyl-rhodanine in 11.19 g of MEK/MeOH (50:50 wt %); it was added before the PHP.

Example 34 contained 0.0195 g of CS-1 in 8.0 g of MEK; it was added at the end of the preparation of the photothermographic emulsion.

Example 35 contained 0.0069 g of N-ethyl-rhodanine in 8.0 g of MEK; it was added at the end of the preparation of the photothermographic emulsion.

Samples were stored in the dark for 5 days under ambient conditions. They were then cut into 1.5 inch by 8 inch strips (3.8 cm×20.3 cm) and exposed using a laser sensitometer incorporating a 810 nm laser diode as described in Example 2 above. After exposure, the film strips were developed on a heated round drum thermal processor for 15 seconds at 255° F. (123.9° F.). Sensitometry was determined as described in Examples 1–4 above.

The results, shown below, further demonstrate that the chemical sensitizing compound must be added before the oxidizing agent to achieve chemical sensitization and to produce photothermographic materials with high speed and low fog. The samples where the chemical sensitizing compound was added before the oxidizing agent have higher Dmax, Speed-2, Speed-3, and Contrast-3 than the samples in which the chemical sensitizing compound was added at the end of the preparation of the photothermographic emulsion. The samples in which the chemical sensitizing compound was added at the end of the preparation of the photothermographic emulsion have similar sensitometry to the control sample which contained no chemical sensitizing compound.

| Ex. | Dmin | Dmax |
|---|---|---|
| 31 | 0.229 | 3.69 |
| 32 | 0.238 | 3.99 |
| 33 | 0.304 | 3.96 |
| 34 | 0.234 | 3.56 |
| 35 | 0.262 | 3.44 |

| Ex. | Speed-2 | Speed-3 | Contrast-1 | Contrast-3 |
|---|---|---|---|---|
| 31 | 1.53 | 1.06 | 4.25 | 3.18 |
| 32 | 1.79 | 1.33 | 4.20 | 3.43 |
| 33 | 1.78 | 1.29 | 4.06 | 5.45 |
| 34 | 1.51 | 1.00 | 4.35 | 2.57 |
| 35 | 1.50 | 0.90 | 4.09 | 1.96 |

Reasonable modifications and variations are possible from the foregoing disclosure without departing from either the spirit or scope of the present invention as defined by the claims.

What we claim is:

1. A method for preparing a photothermographic emulsion comprising the steps of:

(a) providing a photothermographic emulsion comprising silver halide grains and a non-photosensitive silver source;

(b) providing an organic sulfur-containing compound positioned on or around the silver halide grains; and (c) chemically sensitizing the silver halide grains by decomposing the organic sulfur-containing compound on or around the silver halide grains in an oxidizing environment.

2. The method of claim 1 which the chemical sensitizing step comprises reacting the sulfur compound from the decomposed organic sulfur-containing compound with the silver halide grains.

3. The method of claim 1 in which the decomposing produces HSBr which chemically sensitizes the silver halide grains.

4. The method of claim 1 in which after chemical sensitization of said silver halide grains, a spectral sensitizing dye is added to said photothermographic emulsion to spectrally sensitize said emulsion.

5. The method of claim 1 wherein said silver halide grains are iridium-doped silver halide grains.

6. The method of claim 1 wherein said silver halide grains comprise silver halide grains which are iridium doped core-shell silver halide grains and after chemical sensitization of said silver halide grains, a spectral sensitizing dye is added to said photothermographic emulsion to spectrally sensitize said emulsion.

7. The method of claim 6 wherein said spectral sensitizing dye sensitizes the chemically sensitized silver halide grains of the photothermographic emulsion to the red or infrared region of the electromagnetic spectrum between 600 nm and 1000 nm.

8. The method of claim 1 further comprising adding a reducing agent to the sensitized photothermographic emulsion.

9. The method of claim 1 wherein the sulfur-containing compound comprises a ring structure having —S— or

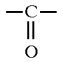

within the ring.

10. A method for preparing a photothermographic emulsion comprising the steps of:

(a) providing a photothermographic emulsion comprising silver halide grains and a non-photosensitive silver source;

(b) providing a sulfur-containing spectral sensitizing dye positioned on or around the silver halide grains; and (c) chemically sensitizing the silver halide grains by decomposing the spectral sensitizing dye on or around the silver halide grains.

11. The method of claim 10 in which after chemical sensitization of said silver halide grains, a second spectral sensitizing dye is added to said photothermographic emulsion to spectrally sensitize said emulsion.

12. A method for preparing a photothermographic emulsion comprising the steps of:

(a) providing a photothermographic emulsion comprising silver halide grains and a non-photosensitive silver source;

(b) providing a sulfur-containing compound comprising a thiohydantoin nucleus, a rhodanine nucleus, or a 2-thio-4-oxo-oxazolidine nucleus positioned on or around the silver halide grains; and (c) chemically sensitizing the silver halide grains by decomposing the sulfur-containing compound on or around the silver halide grains.

13. A method for preparing a photothermographic emulsion comprising the steps of:

(a) providing a photothermographic emulsion comprising silver halide grains and a non-photosensitive silver source;

(b) providing a sulfur-containing compound positioned on or around the silver halide grains; and (c) chemically sensitizing the silver halide grains by providing an oxidizing compound which causes the decomposing of the sulfur-containing compound on or around the silver halide grains.

14. The method of claim 13 wherein the oxidizing compound is present in a solution, said solution is in contact with said silver halide grains, and the chemical sensitizing step occurs at a temperature above about 20° C.

15. The method of claim 14 where the temperature is between about 20° C. and about 40° C.

16. The method of claim 13 wherein said oxidizing compound is pyridinium hydrobromide perbromide.

17. A method of forming a sensitized photothermographic emulsion comprising the steps of:

(a) providing a photothermographic emulsion comprising silver halide grains and a non-photosensitive silver source;

(b) providing a sulfur-containing spectral sensitizing dye on or around the silver halide grains;

(c) decomposing the spectral sensitizing dye in an oxidizing environment at a temperature between about 20° C. and about 40° C.;

(d) adding a second spectral sensitizing dye to said photothermographic emulsion to spectrally sensitize said emulsion.

18. A method of making a photothermographic element comprising:

(a) preparing a photothermographic emulsion according to claim 1;

(b) adding a reducing agent and a binder to the photothermographic emulsion;

(c) coating the photothermographic emulsion on a substrate.

19. A method for chemically sensitizing silver halide grains comprising the steps of:

(a) providing a silver halide grains;

(b) providing a sulfur-containing sensitizing dye on or around the surface of silver halide grains; and (c) oxidatively decomposing the sulfur-containing sensitizing dye thereby chemically sensitizing said grains.

* * * * *

UNITED STATES PATENT AND TRADEMARK OFFICE

CERTIFICATE OF CORRECTION

PATENT NO. : 5,891,615
DATED : April 6, 1999
INVENTOR(S) : John M. Winslow et al.

It is certified that error appears in the above-identified patent and that said Letters Patent is hereby corrected as shown below:

Column 51,
Line 12, claim 9 should read:

9. The method of claim 1 wherein the sulfur-containing compound comprises a ring structure having —S— or

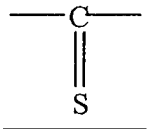

within the ring.

Signed and Sealed this

Sixteenth Day of March, 2004

JON W. DUDAS
*Acting Director of the United States Patent and Trademark Office*